United States Patent [19]

Blake

[11] 3,977,534

[45] Aug. 31, 1976

[54] WALL INDEXING MACHINE

[75] Inventor: William R. Blake, Tulsa, Okla.

[73] Assignee: Aquarius, Inc., Tulsa, Okla.

[22] Filed: Oct. 15, 1974

[21] Appl. No.: 515,050

[52] U.S. Cl. ..... 214/1 H; 52/749; 156/60; 214/1 SW; 214/1 D; 214/651

[51] Int. Cl.[2] ..... E04F 21/18

[58] Field of Search ..... 52/749, 121; 214/1 R, 214/1 Q, 1 H, 1 SW, 1 S, 1 D, 650, 651, 730, 750

[56] References Cited

UNITED STATES PATENTS

| | | | |
|---|---|---|---|
| 3,361,280 | 1/1968 | Traver | 214/1 SW X |
| 3,842,988 | 10/1974 | Russell | 214/1 H X |
| 3,895,721 | 7/1975 | Russell | 214/1 D X |

*Primary Examiner*—Frank E. Werner
*Attorney, Agent, or Firm*—Wilfred G. Caldwell

[57] ABSTRACT

For transporting and indexing panel wall sections, a wheeled base chassis supports a lateral movable plate, in turn carrying three separate frames for performing the various orienting functions. The innermost frame is pivotally carried by the lateral plate to permit all three frames and the panel load to be tilted rearwardly over the chassis for transport. This frame carries the middle frame to permit it to be driven vertically relative to the innermost frame for fitting the panel into position, as a first portion of the wall or a continuing portion. The middle frame carries the outer frame with it and also mounts it for 45° motion relative to the middle frame to remove the panel from its aligned or home position for the application of adhesive, with the machine returning it exactly for final bonding, the chassis being leveled or tilted by opposed levelers extendable against the floor. Upper and lower clamps grip the previously installed panel and face the panel in the machine against it with forces of 500 or more pounds to initiate a good tight fit, after the panel has been nearly fitted, the lateral plate permitting it to be brought initially adjacent the previously installed panel.

20 Claims, 51 Drawing Figures

403
401
405
400
407

WALL INDEXING MACHINE

This invention is an improvement over the application of Carl D. Russell, Ser. No. 274,136, filed July 28, 1972, and entitled INDEXING PANEL INSTALLER, now U.S. Pat. No. 3,895,721 issued July 22, 1975.

The prior invention relates to the handling of plywood sandwich panel loads in the erection of exterior and interior walls, primarily in home construction. The pre-made panel comprises an interior member, such as plywood, preferably with interior house finishing, an insulating member, such as polyurethane foam of several inches in thickness, and an exterior member, usually of plywood but finished to exterior appearances. A 2 × 4 frame retains the insulation and holds the structure together. Indexing holes through this frame permitted gripping of such panels by extensions of the machine, preferably located near the bottom two corners of the interior plywood panel and one extending vertically downward to penetrate the top 2 × 4 member. The machine then picked up the panel to be erected, moved it to its approximate position, then indexed it to take into account floor irregularities or out-or-plumb assemblies, then removed the panel along a predetermined track, usually 45°, to permit the application of adhesive for subsequent bonding, with the machine being retained in place to home the panel to the aligned position.

The present invention is independent of electrical supplies and operates solely through pneumatic or manual controls, the workload being usually handled pneumatically. A feature of the invention permits the handling of sandwiched panels including 9 foot long panels for the exterior of the house being constructed, which obviates further finishing and provides a useful overhang. Also, the provision of novel pins for gripping the sandwich panels avoids holes penetrating through the panels and thus maintains factory appearances. Such pins project into openings in the panel frames which include vertical nails or the like. Partial rotation of the pins causes the nail to be gripped in a slot and captured for good connection of the panel to the machine for handling.

The present invention provides a base, comprising four wheels which never leave the floor, but support the load and provide for mobility to transport the same. In addition, three or more load bearing wheels may be aligned along the front end of the machine as nearly directly under the load as possible (it being borne in mind that the load is usually joined to the floor by adhesive and therefore nothing can be directly under it).

The base chassis supports a lateral baseplate which carries three generally parallel frames arranged to pivot rearwardly approximately 11°, thereby bringing the center of gravity of the load more directly over the base. The first frame (frame No. 1) is pivotally attached to the lateral plate supported above the base chassis. This permits the backward tilt and also allows for slight forward tilt for orienting the load which is carried by the forward or No. 3 frame. The No. 2 frame is provided for vertical movement relative to the No. 1 frame and carries with it frame No. 3 and the load.

The front frame No. 3 traverses along a 45° predetermined path to carry the load away from its final resting place to permit the application of adhesive to either the load or the floor and the previous panel, with homing being assured by locking the machine to the floor. A cylinder carried by frame No. 2 reciprocally drives the frame No. 3 along a shaft carried by frame No. 3.

The lateral movement of the panel load is available as a result of the lateral plate being supported from four linear ball bushings adapted to travel laterally of the base along a pair of spaced-apart rods or shafts carried by shaft support blocks above the base. A lateral manual driving arrangement is provided with mechanical advantage to provide for sufficient force to fit tongue and groove joints, if employed. It also incorporates parallel movement provisions to maintain alignment and lengthen the life of the machine.

Three lower moveable pins are provided, two for gripping the panel load and one for enabling large pressure such as 500 to 800 pounds to be pneumatically applied between an existing fixed panel and the panel to be joined thereto in order that tight connection is assured.

An adapter bar and associated structure are provided at the top of the panel and the fixed panel to apply pneumatically the same clamping force at the top of the adjacent panels. Various size adapter bars may be provided for different size panels.

The machine includes a U-shaped handle for manual propelling of the same and a console panel with the necessary controls, primarily valves that are opened and closed for pneumatic operation, all such valves, pressure regulators and operating pneumatic circuitry being commercially available. Detented sequence controllers are utilized for operating a series of valves in sequence or at random to perform the operations necessary to inserting pins Nos. 2 and 3 into the panel load, turning the pins to lock the same, and gripping the panel by withdrawing the pins in locked position to force the panel tightly against frame No. 3. Also, the clamping of pin No. 1 for the lateral movement, as well as the top clamp or adapter bar controls are included in the console.

Furthermore, the vertically up and down movement is controllable, as is the 45° transverse movement. Finally, the panel load can be tilted to the right or left to compensate for slight irregularities of the sub-flooring.

With all three of the valve control knobs of the console in approach position, the operator pushes the machine over to the panel to be picked up as a load for the machine. Next, the operator checks the pins which are on the lower extremity of panel handling railroad frame 3 (pins No. 2 and No. 3) to see that they align with the holes at the bottom of the panel to be loaded. If the pins are aligned properly, then the operator turns the No. 2 and No. 3 pin control knob to the first detented position which inserts the pins into the holes. He then turns the knob to lock which rotates the pins, thus locking them to respective nails in the panel openings, next knob movement pulls bottom of panel to frame No. 3. Then he takes the top clamp knob on the control console and turns this to grip (the second position) which drops the top clamp down onto an adapter bar which is securely fastened to the top of the panel. At this time the machine is completely latched onto the panel.

The operator then grasps the up/down lever with his hand and raises the panel just far enough off the floor so that the machine is completely supporting it. After he has done this, then he turns a switch which is on the control console which will tilt the entire frame 1, 2 and 3 assembly, with the panel attached, rearwardly 11°, to move the center of gravity of the load far enough back so that there is no danger of the load possibly tipping over. The operator is then ready to move the panel over to the site for placement. After the operator has crossed the floor to his proposed assembly site, he tilts the frame 1, 2 and 3 assembly back to the upright position, bringing the panel to the vertical. At this time, if he so desired, through the use of the plumb adjustment knob, which is located just to the left of the control console, he can plumb his panel to a perfect upright position, or if the existing wall is not quite plumb, he can wiggle the controls to make the panel coplanar with the existing wall or structure.

To initiate installation, he lowers the panel down to where it just touches the floor. He does this with the use of the up/down lever. As soon as the panel is just touching the floor, he grasps the lateral adjustment knob, which is located just to the right of the center of the console, so he can laterally move the panel back and forth. This is a mechanical manual operation. He is able to move the panel laterally to the proper placement position. Once the panel is located exactly in home position, the machine is automatically locked into position by use of a caliper pneumatic brake. This locks the lateral movement.

Pin No. 1 is still out on approach. At this time the operator will grasp the first knob (pin No. 1 knob) on the console on the lefthand side and will rotate it one position which inserts the pin into the last hole in the previously set panel. He then turns the knob one more position, which locks the pin into the fixed panel, and then rotates the knob to still another position which grips the No. 1 pin housing securely to the previously set panel. He then grasps the third knob on the console and rotates it one more position which drops the top clamp gripper onto the pin that it is picking up on the previously set panel. He then rotates both the first (pin No. 1) and third (top clamp) knobs to the clamp position, which exerts approximately 500–800 pounds fo clamping force between the two panels. However, it is not necessary that clamping at the top and bottom be initiated simultaneously.

With the panels clamped together he then goes over to the righthand side of the console and lowers the levelers. The levelers are underneath the chassis baseplate on either side of the machine. With the levelers in position, they are then locked. This will hold the machine securely in the position that the operator chooses. This can cause the machine to move slightly in order to make perfect alignment. Now that the machine is level, the operator reaches up and grasps the No. 1 (No. 1 pin) and number 3 (top clamp) knobs again and rotates them to the unclamp position. What this does is free the machine from the clamping action.

Then, the operator reaches over and grasps (on the righthand lower extremity of the console) the switch that will raise the panel that is attached to the machine at a 45° angle to the floor. What this does is open a gap between the panels and under the panel that is attached to the machine so that adhesive can be applied. When the adhesive has been properly applied, the operator will then flip the same (45°) switch back to the lower position, which will cause the panel to be placed exactly back into the home or aligned position. This is the purpose of having 45° movement and levelers to securely hold the machine.

As soon as the panel has dropped back into its original place, the operator will then grasp the No. 1 and No. 3 control knobs again, and will rotate both of them to the clamp positions. Then the operator must wait a specified amount of time for the adhesive to gain its first set. The adhesives preferred are commercially available construction adhesive solvent base high body adhesive or early high strength hot melt thermoplastic adhesive. Ater that time, the operator will grasp the No. 1 control knob. He will turn it to the unlock position and then he will rotate it onto the pull pin position to remove pin No. 1. He will then grasp the No. 2 control knob and turn it to the release position. Then he will turn it to the pull pin position, removing pins No. 2 and No. 3. The operator then grasps the No. 3 control knob and rotates it to unclamp position. Then he will rotate it to the release position to remove the top clamp. The operator will then go over to the upper righthand portion of the console and will lift the leveller valves so that the levellers are retracted. The operator then is ready to back the machine up and start his procedures over again with the next panel.

The vertical movement that the machine incorporates is actuated by a pneumatic motor. This enables the machine to raise the No. 2 and No. 3 frames a maximum of 22 inches off the floor. The purpose of this is due to a construction method in which the outside of a house can have an unbroken sheath of sheathing from the top of the panel all the way down past the floor line of the house. Also, it facilitates an ease of adjusting the panel upwards or downwards or to align the pins to the holes in the panel for the pick-up procedure, there is a fine manual adjustment which is controlled through knobs that are just above and to the right and to the left of the console.

The invention will next be explained in detail with reference being had to the figures of the drawings wherein.

Figure 11:
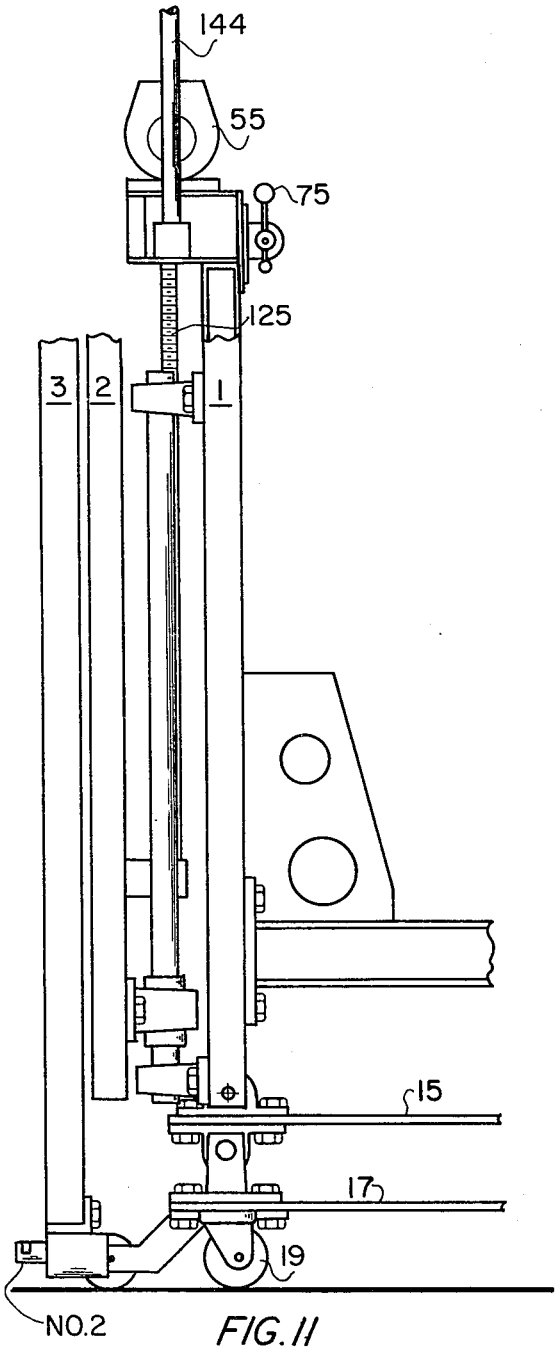
Figure 12:
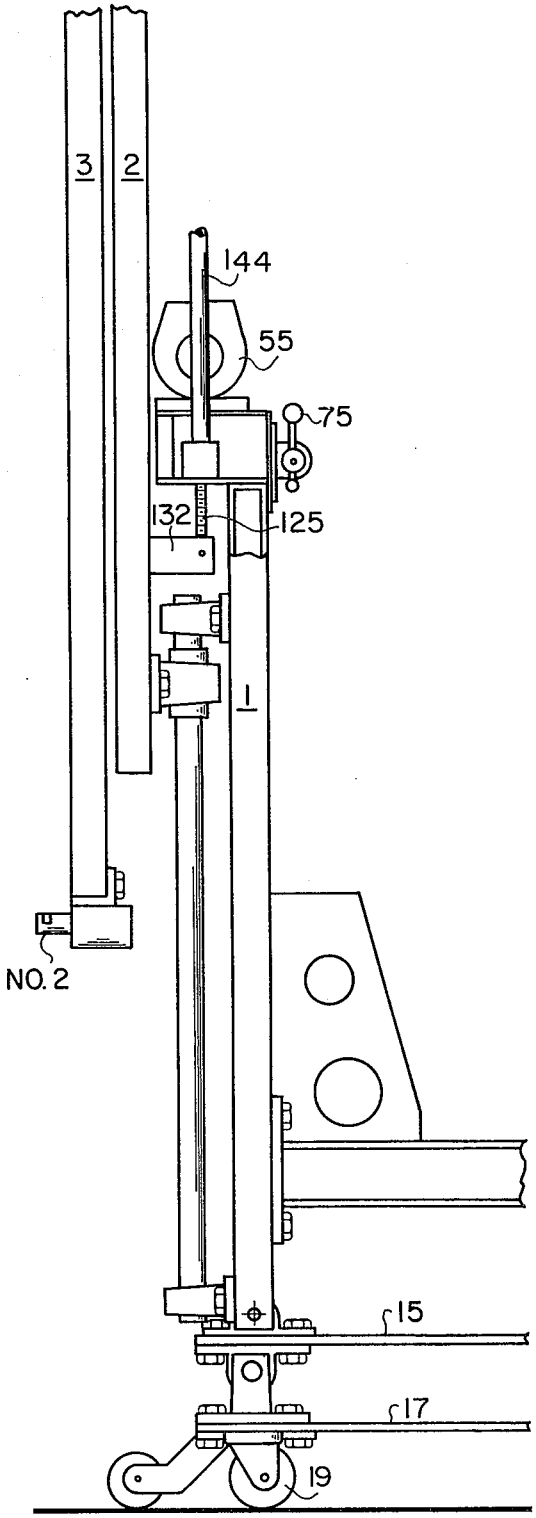
Figure 13:
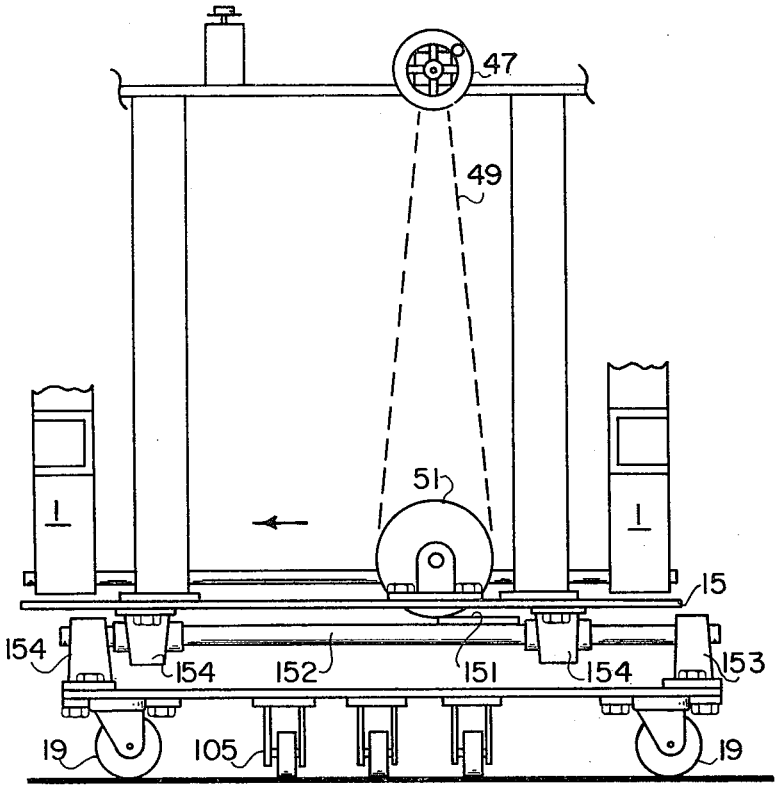
Figure 14:
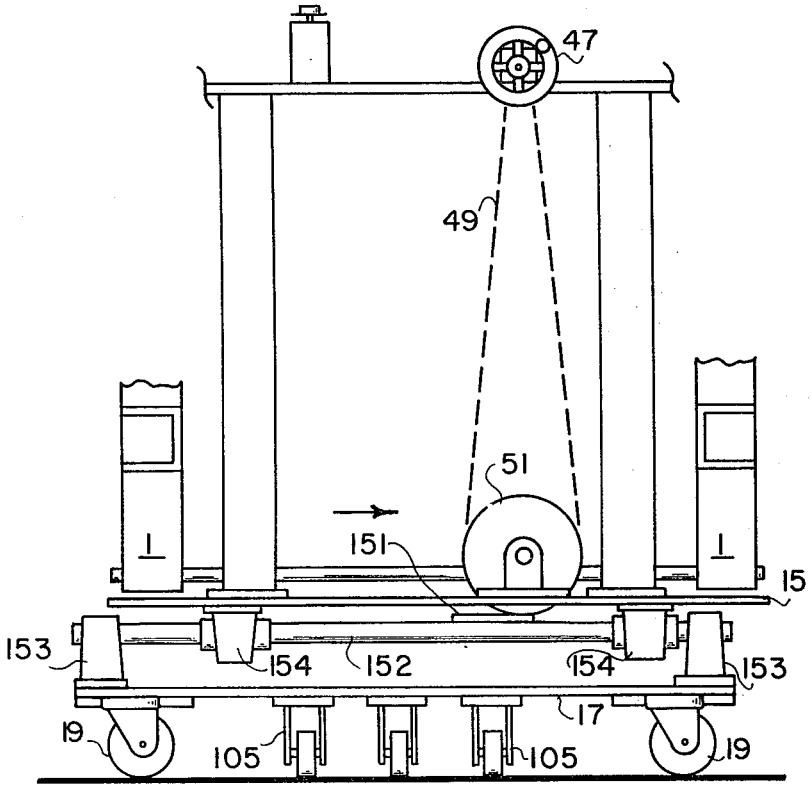
Figure 15:
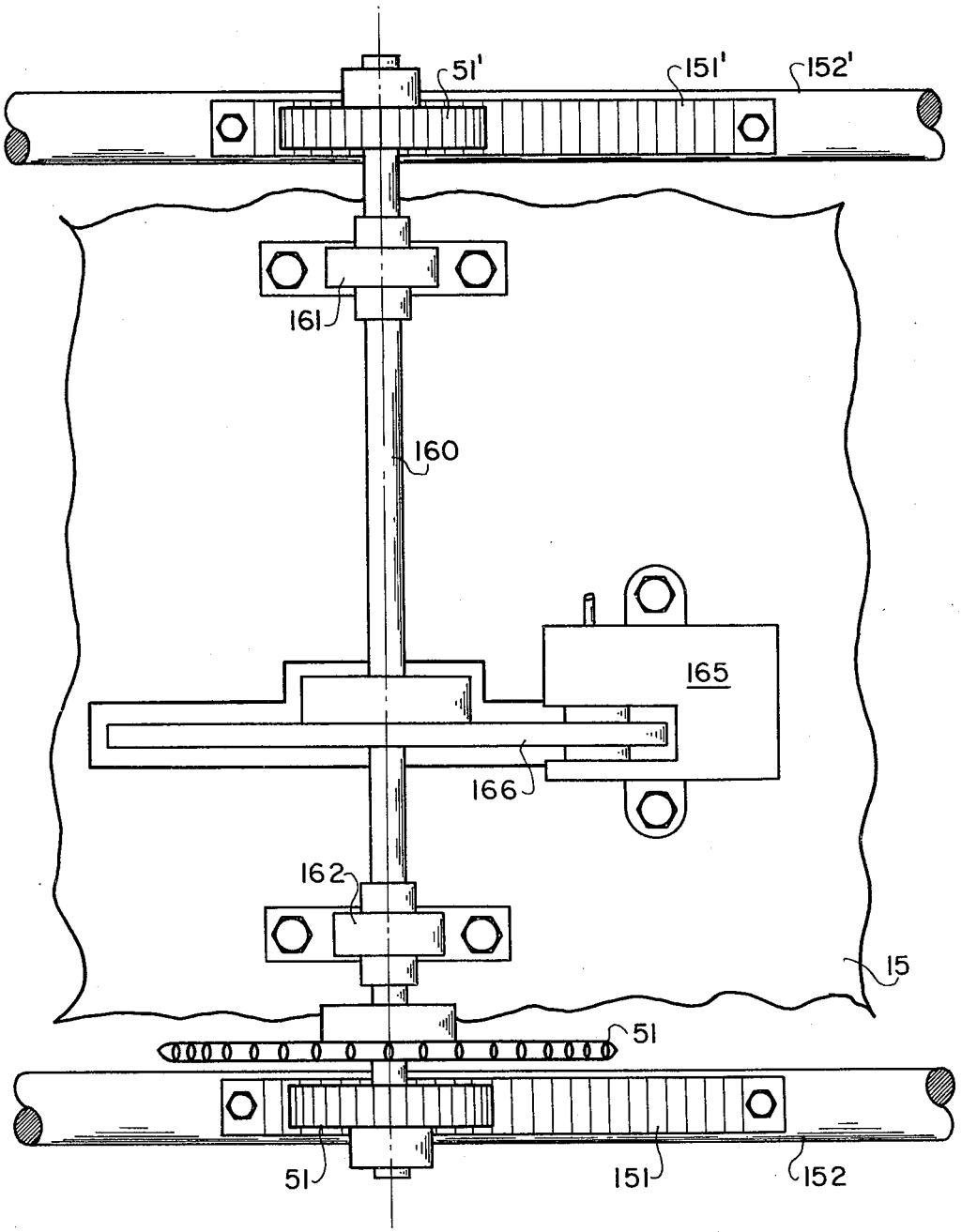
Figure 16:
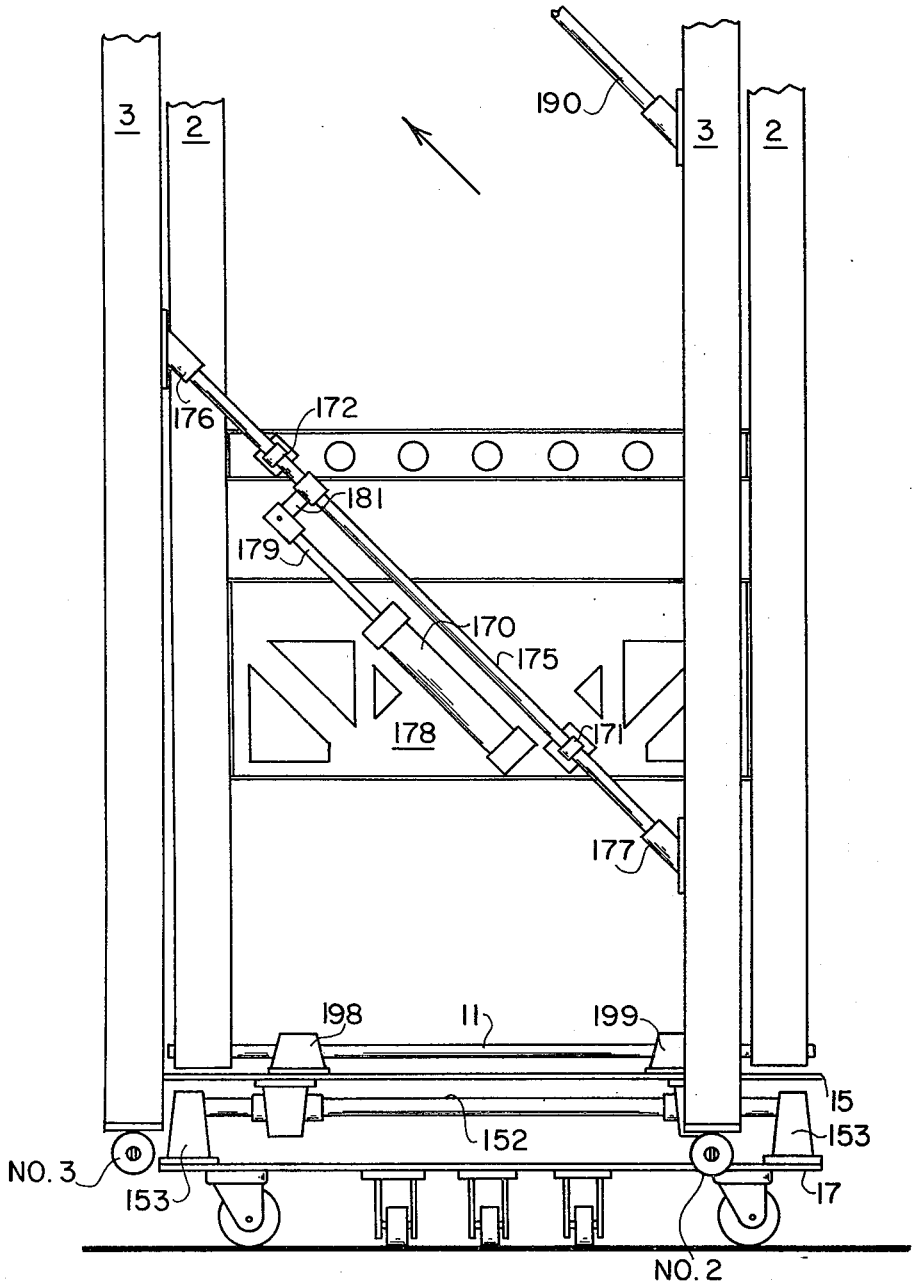
Figure 17:
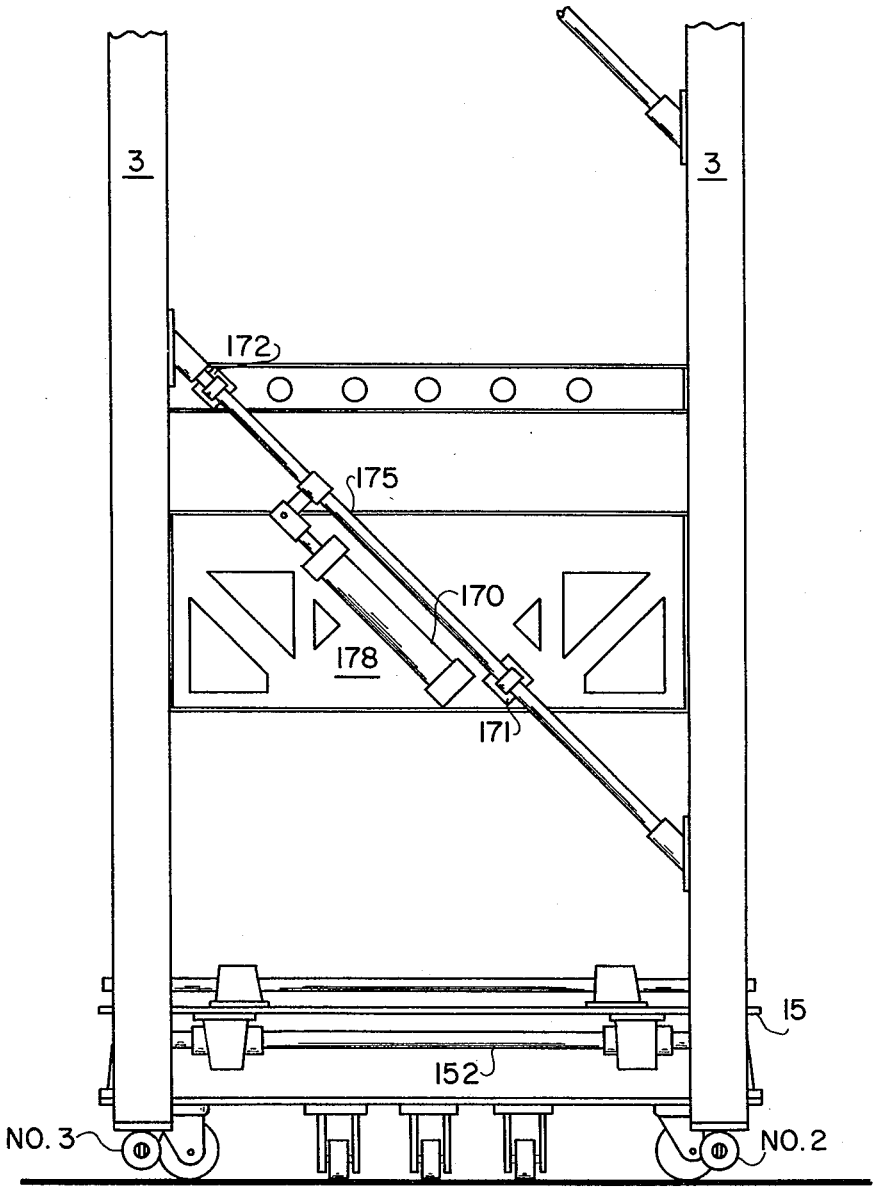
Figure 18:
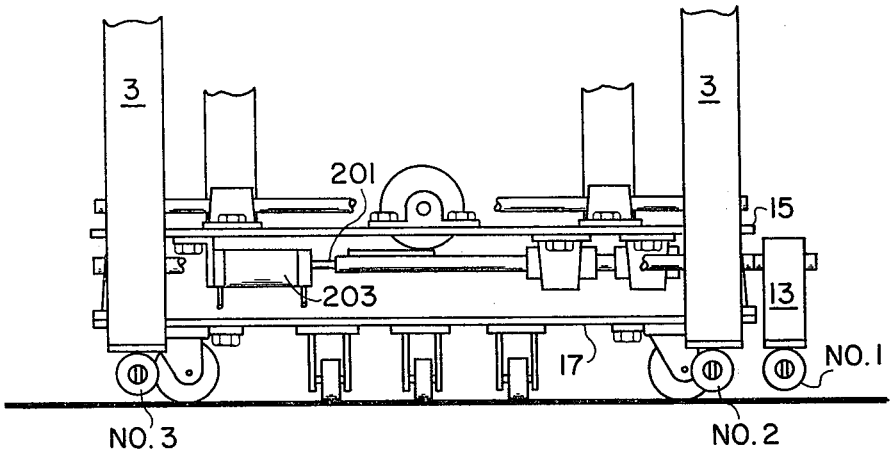
Figure 19:
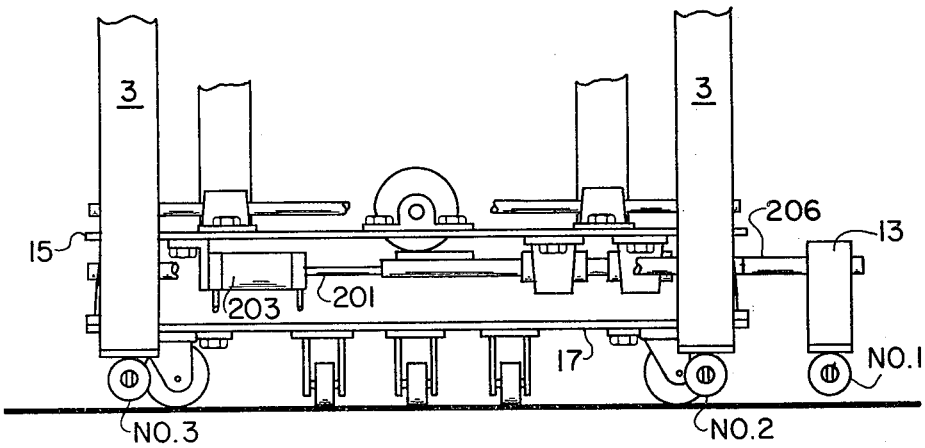
Figure 20:
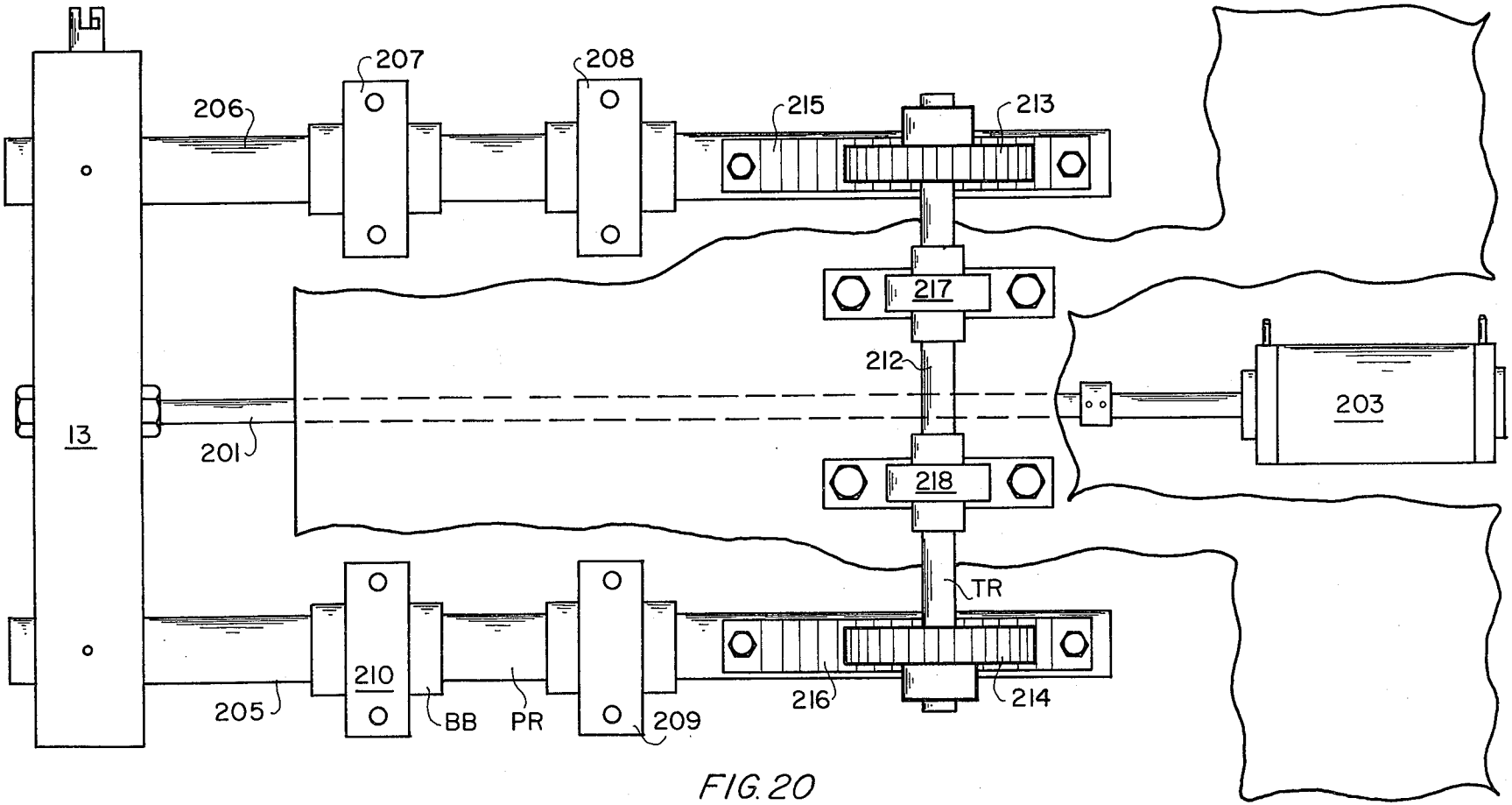
Figure 21:
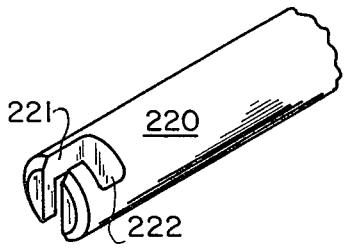
Figure 23:
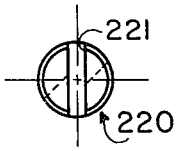
Figure 25:
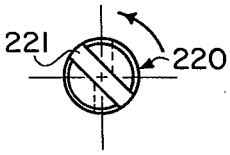
Figure 22:
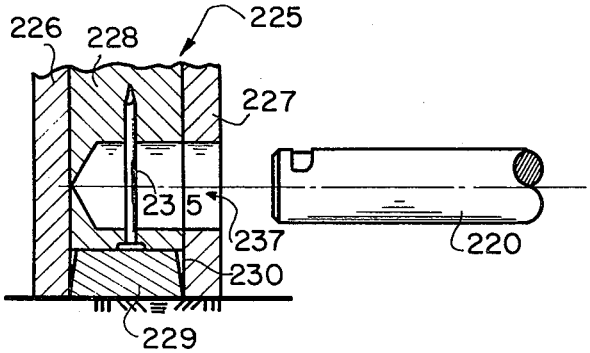
Figure 24:
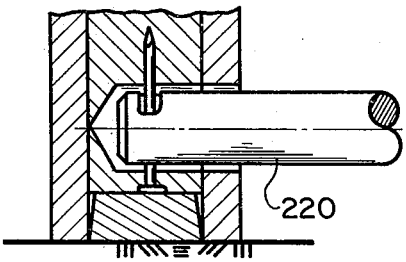
Figure 26:
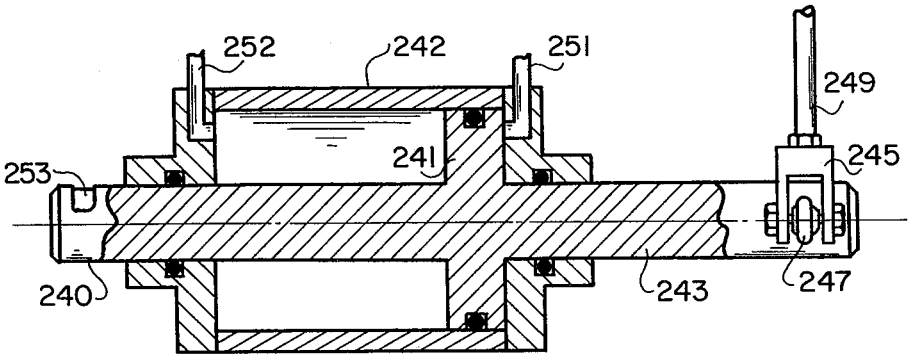
Figure 27:
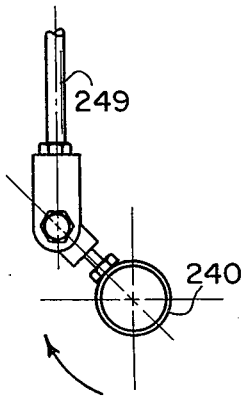
Figure 28:
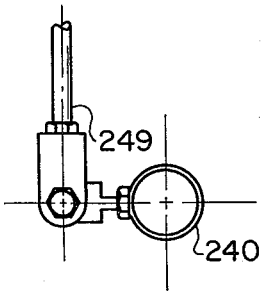
Figure 29:
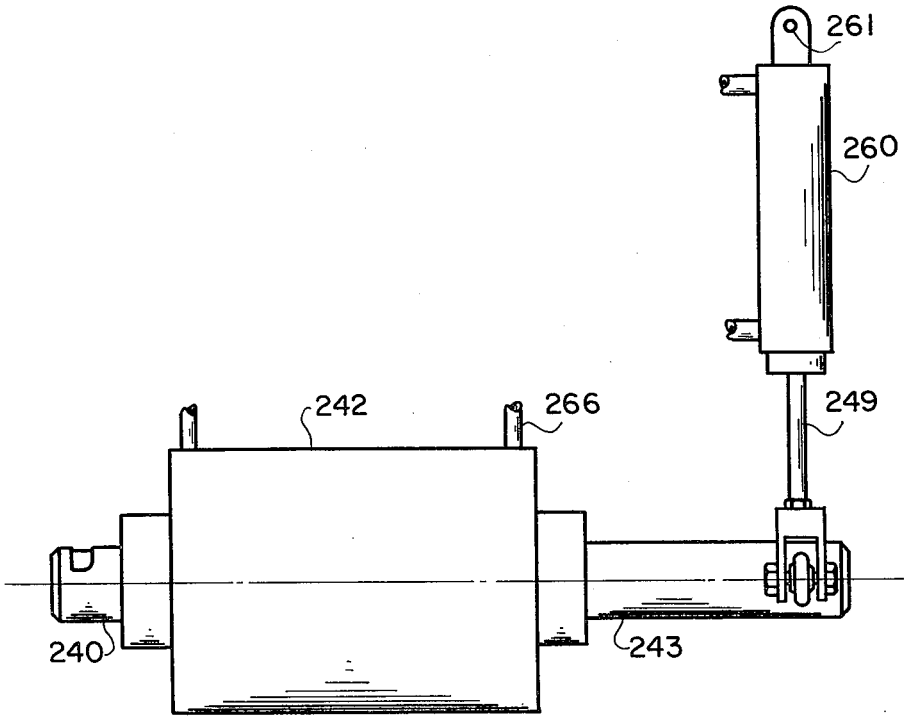
Figure 30:
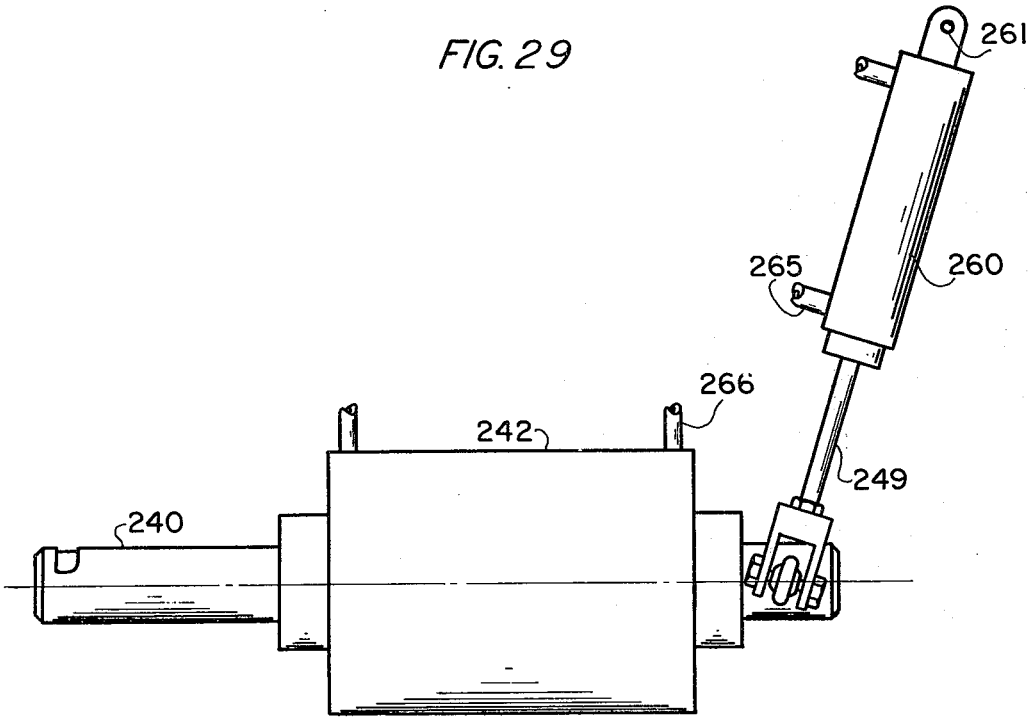
Figure 31:
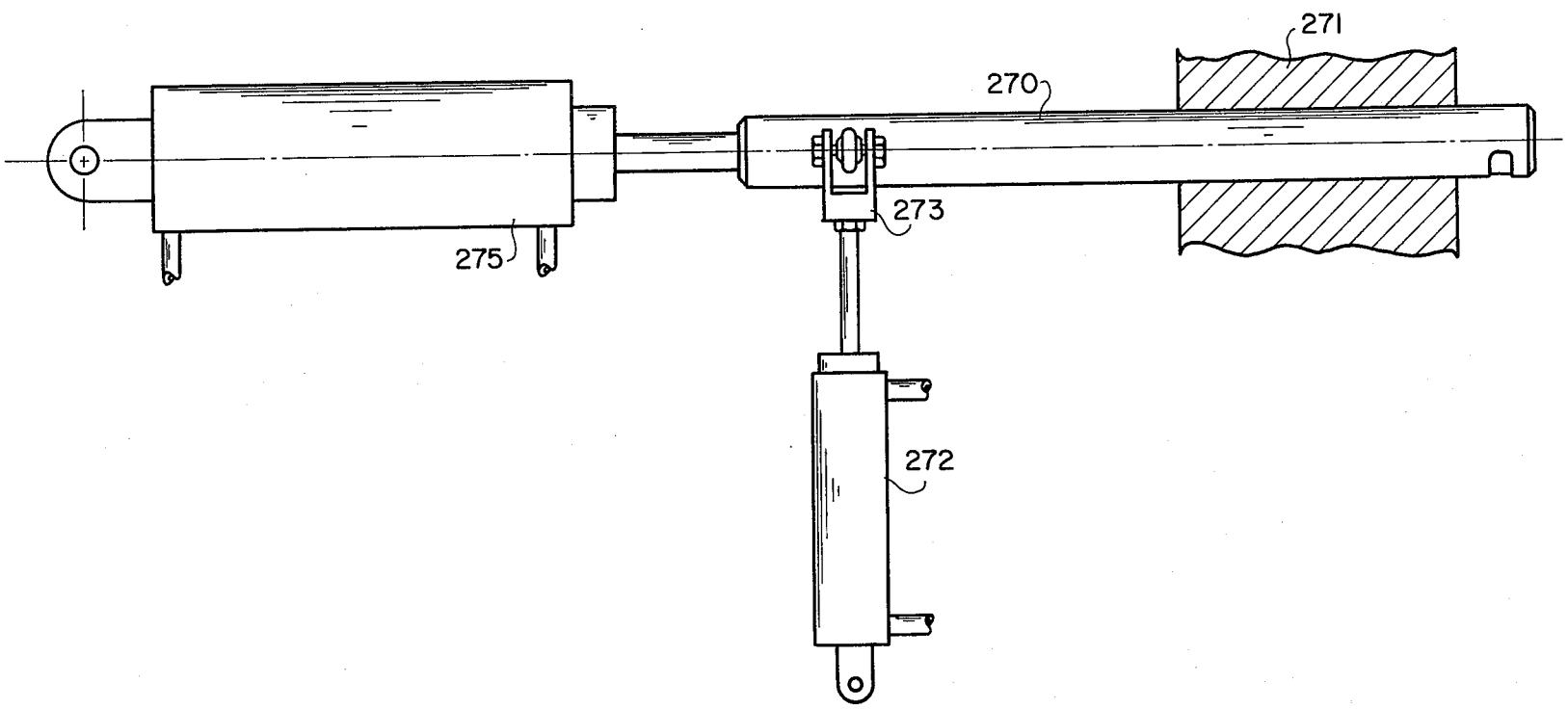
Figure 33:
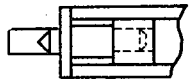
Figure 34:
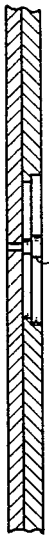
Figure 35:
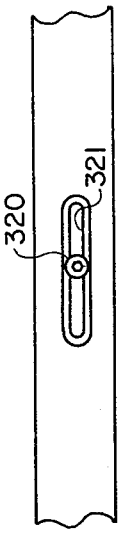
Figure 32:
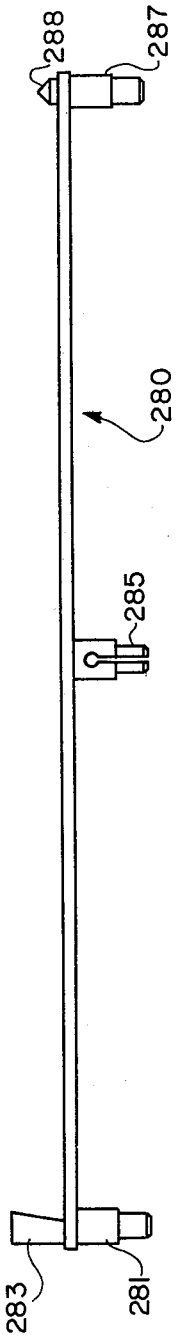
Figure 36:
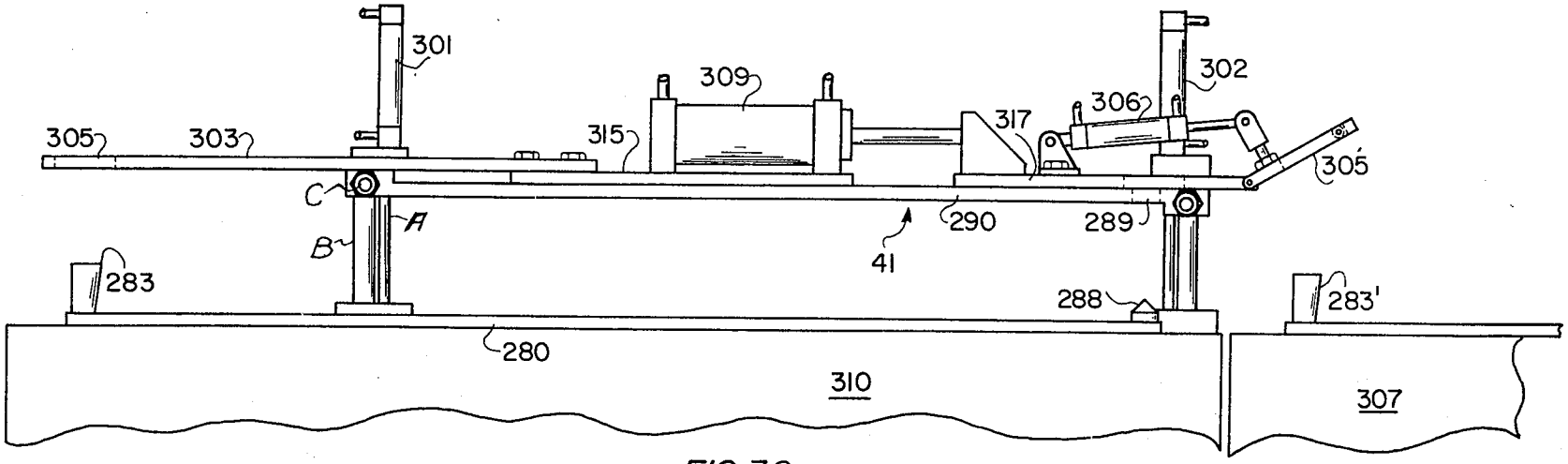
Figure 37:
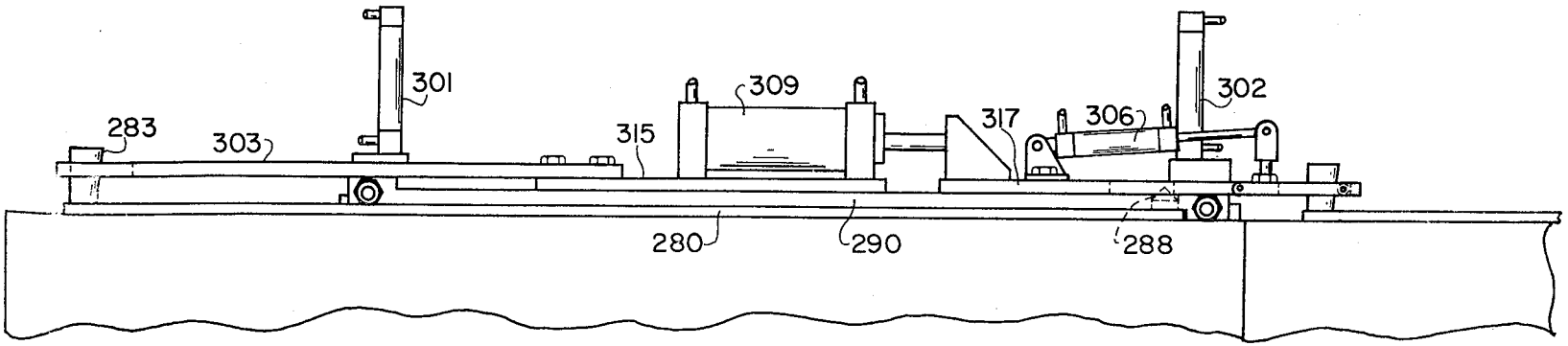
Figure 38:
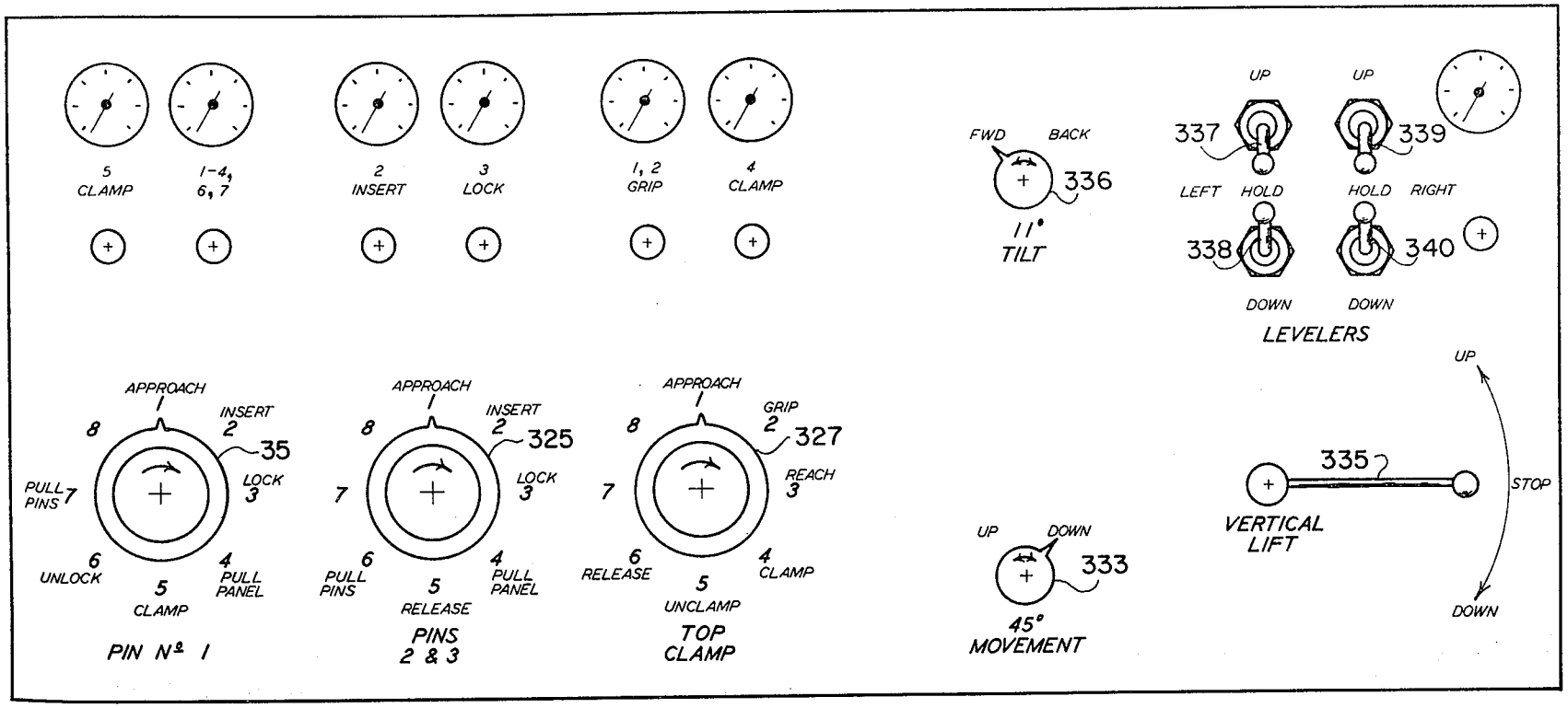
Figure 39:
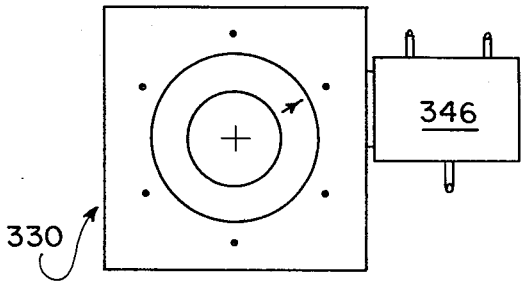
Figure 40:
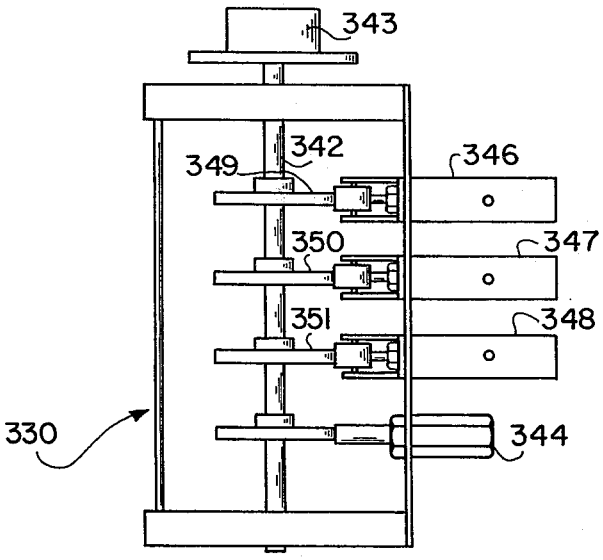
Figure 41:
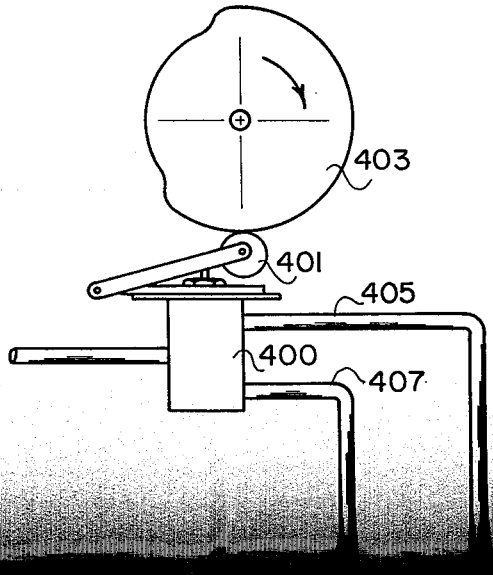
Figure 42:
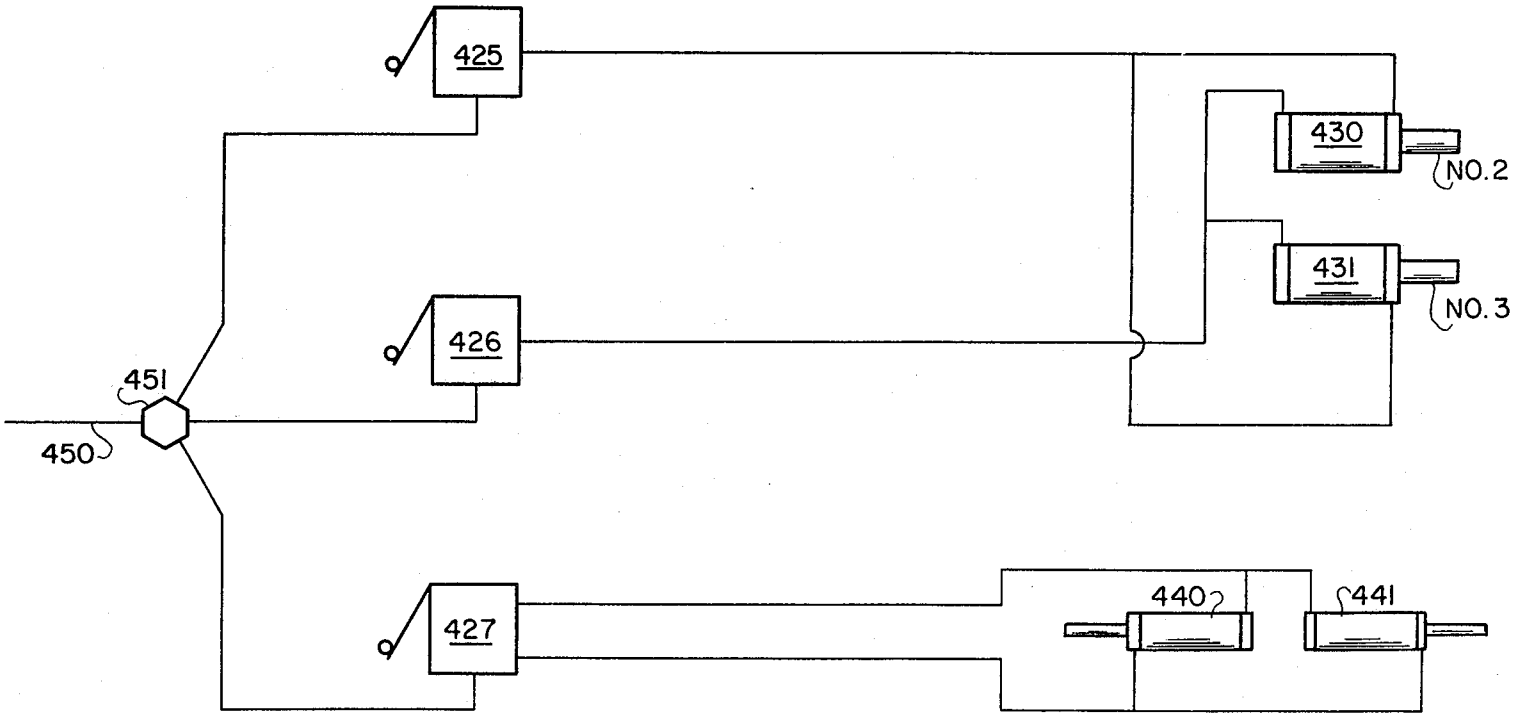
Figure 43:
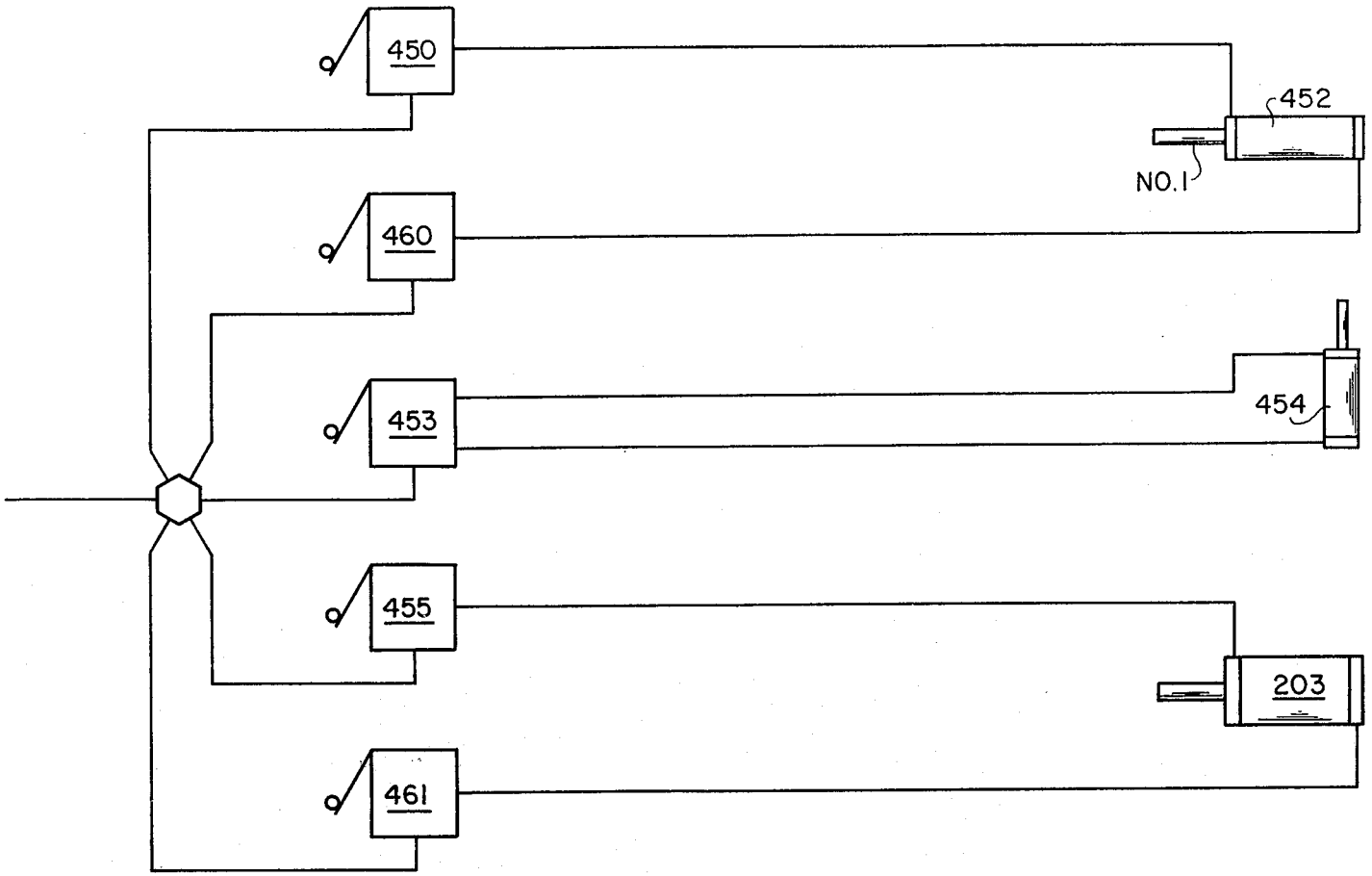
Figure 44:
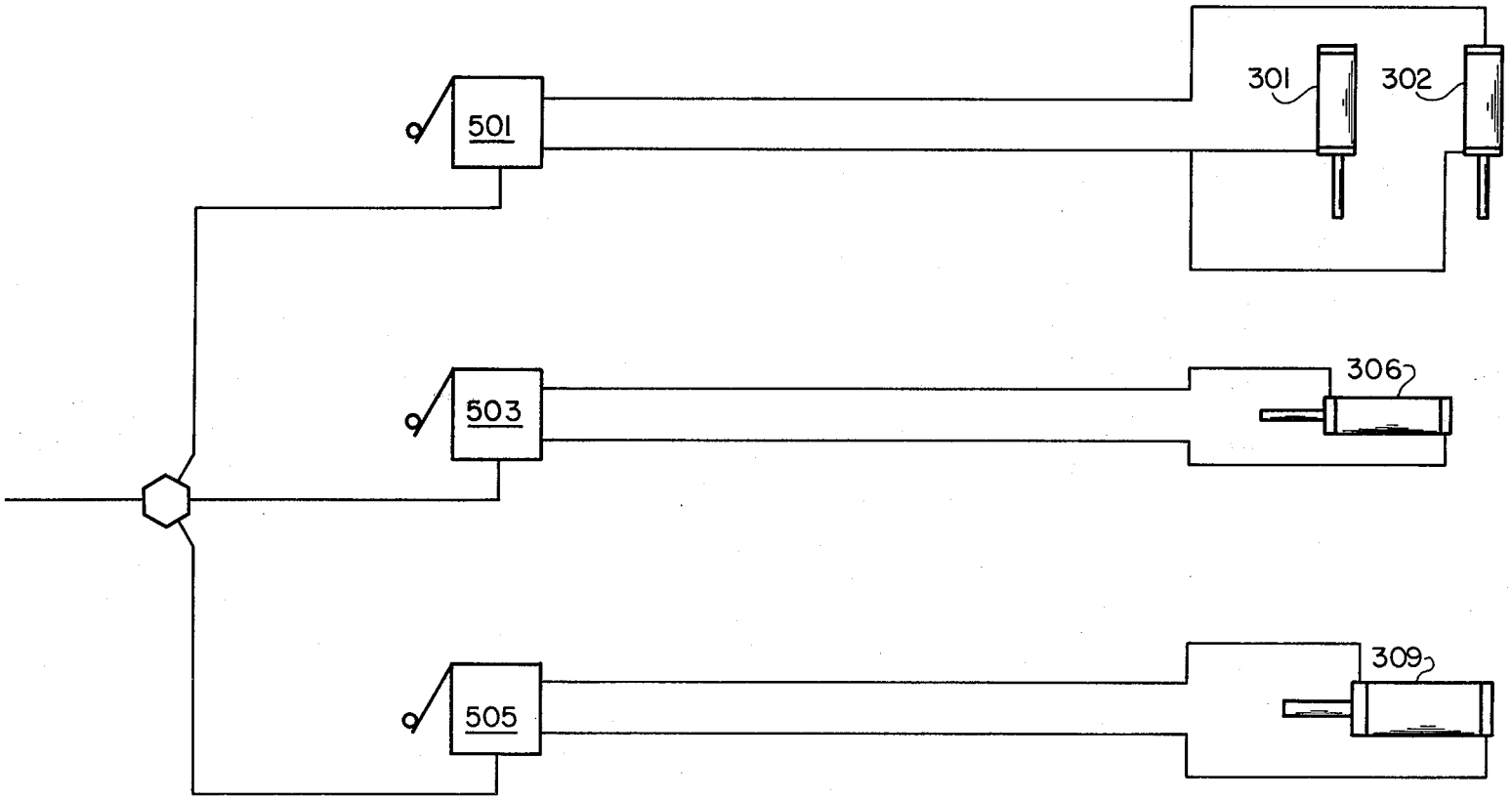
Figure 45:
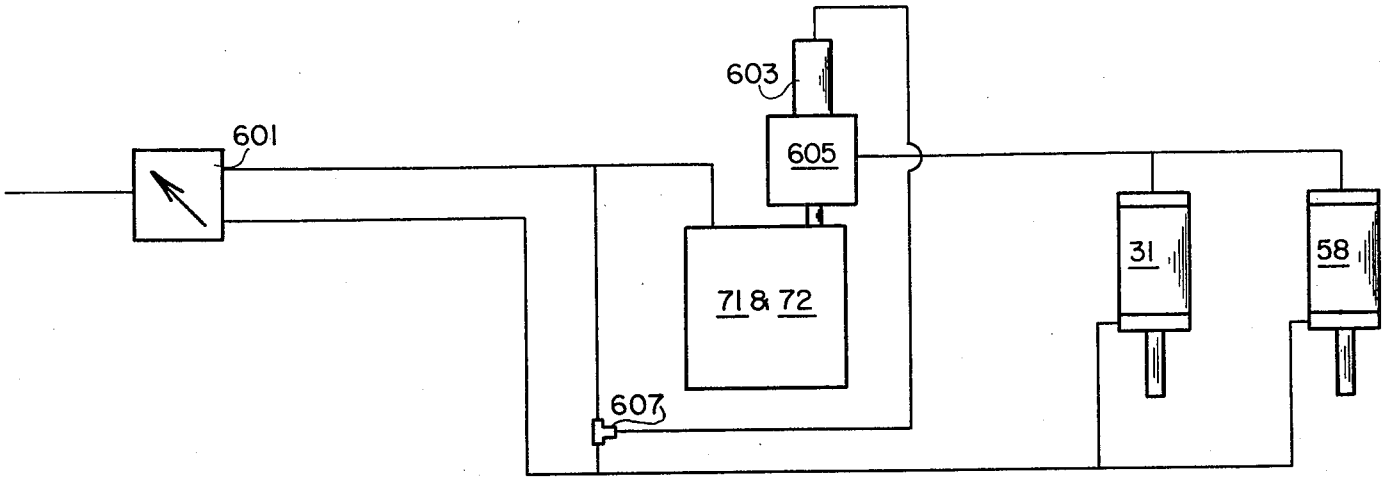
Figure 46:
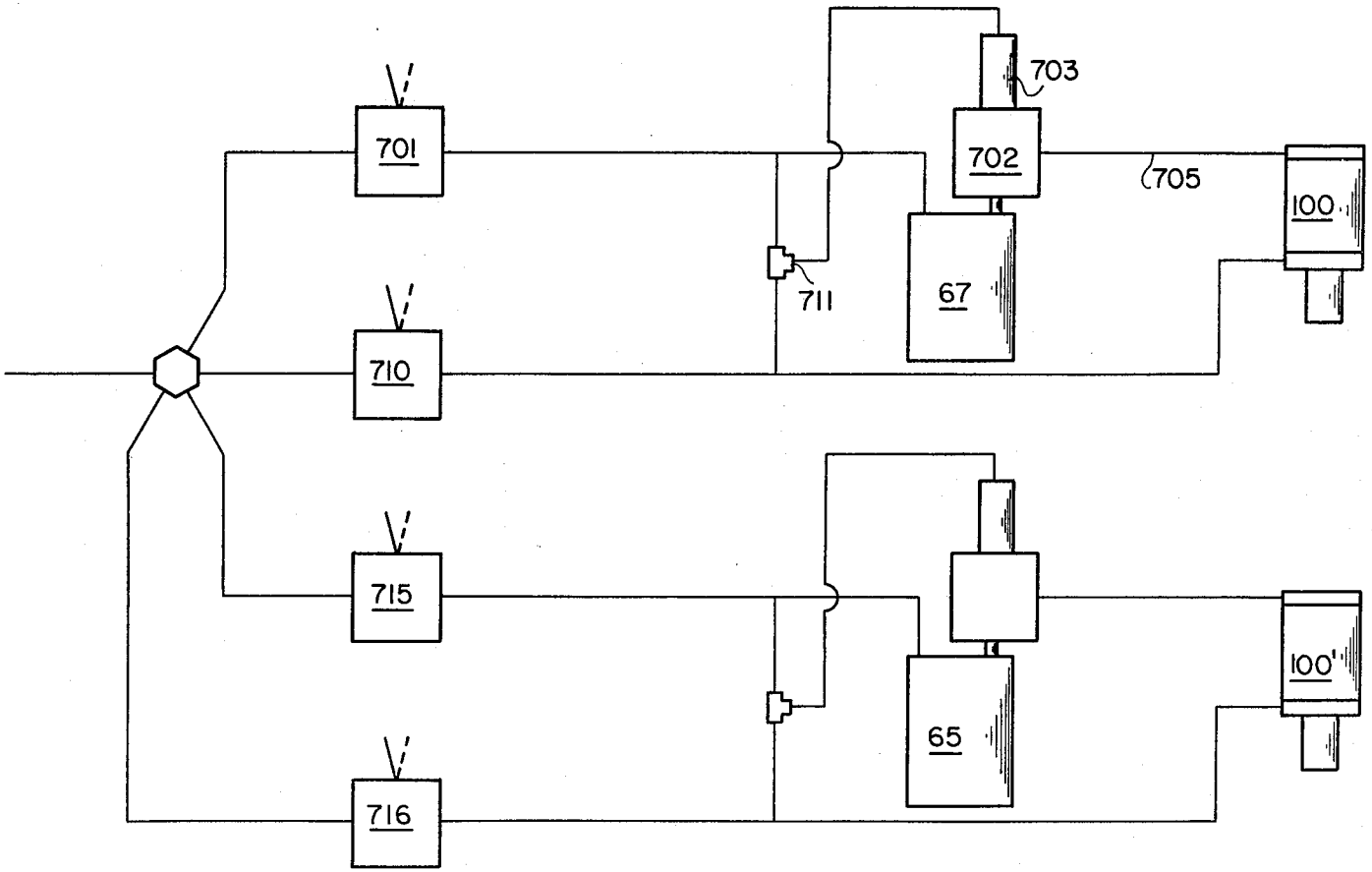
Figure 48:
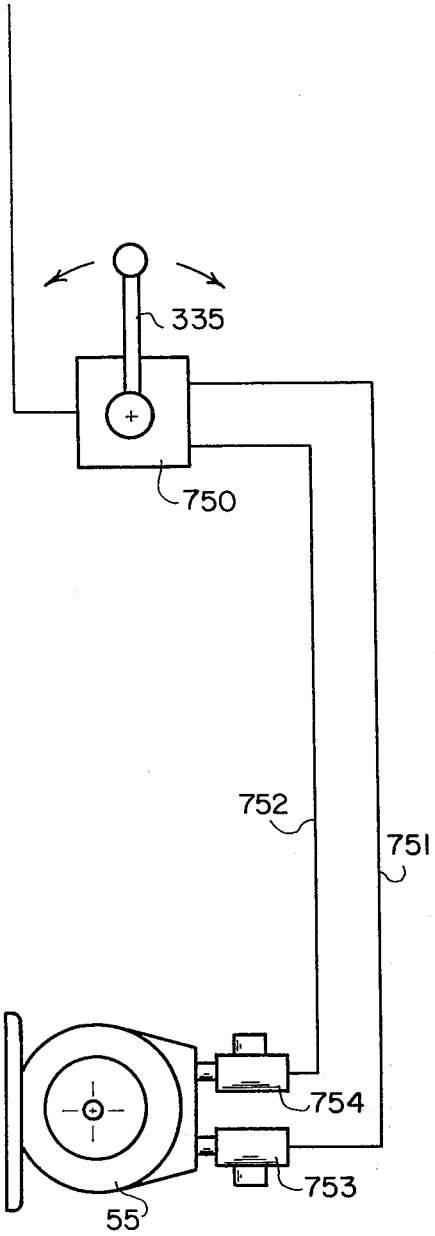
Figure 47:
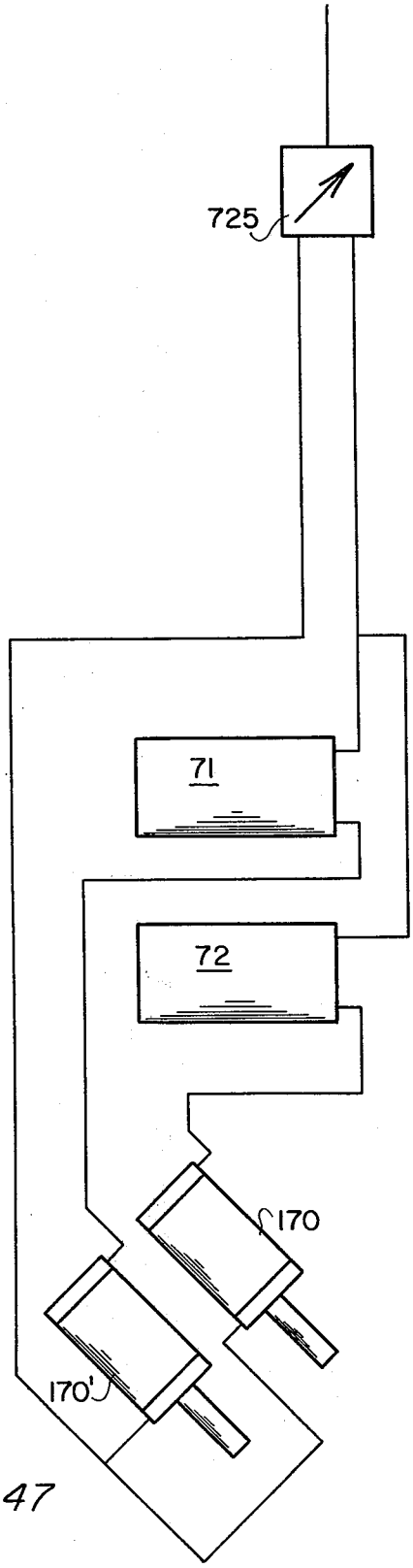
Figure 49:
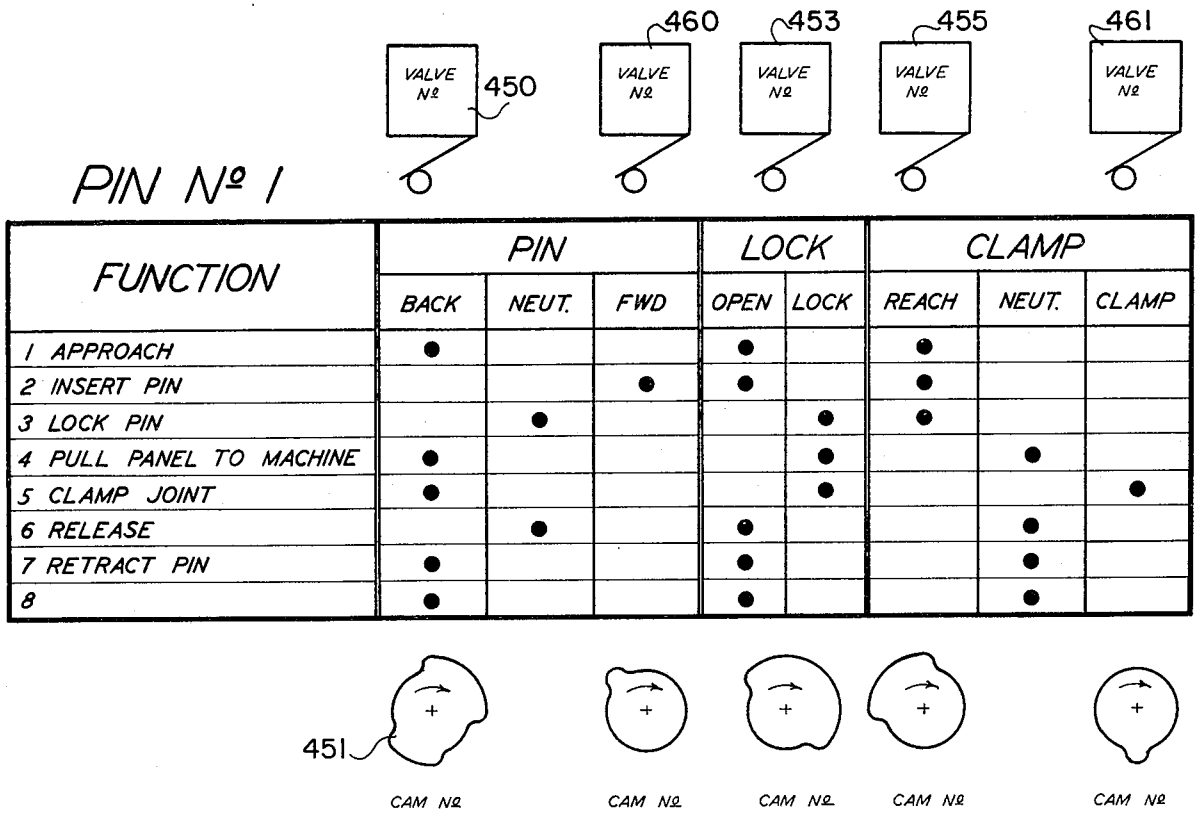
Figure 50:
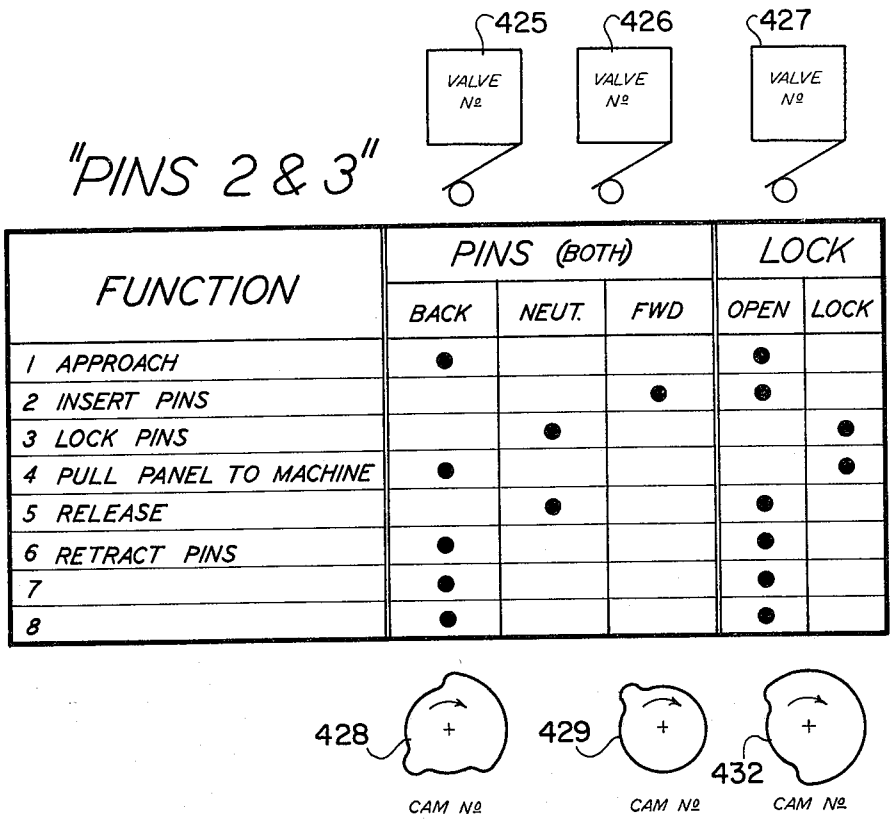

FIG. 11 adds the vertical lift assembly to a portion of the machine in side elevation;

FIG. 12 shows the machine of FIG. 11 with frames 2 and 3 in upper position;

FIG. 13 is a partial view of the machine to show the lateral movement mechanism;

FIG. 14 shows the same portion of the machine with lateral displacement in the opposite direction;

FIG. 15 is a plan view of the parallel drive mechanism for lateral movement;

FIG. 16 shows a portion of the machine in front elevation to detail the 45° traverse mechanism;

FIG. 17 is a view of the mechanism of FIG. 16 in lowered position;

FIG. 17 is a view of the mechanism of FIG. 16 in lowered position;

FIG. 18 shows the lower clamping mechanism in retracted position;

FIG. 19 shows the same mechanism in extended position;

FIG. 20 is a plan view of the bottom clamp mechanism showing the parallel drive therefor;

FIG. 21 is a view in perspective of a preferred pin;

FIG. 22 shows the pin in relation to a wooden wall panel;

FIG. 23 shows the position of the slot of the pin upon approach;

FIG. 24 shows the pin engaging the nail to lock the wall panel to the machine;

FIG. 25 shows the position of the slot in capturing the nail;

FIG. 26 shows the interior of a pin and operating mechanism;

FIG. 27 shows the mechanism in position capturing the nail;

FIG. 28 shows the other position of the structure of FIG. 27;

FIG. 29 shows the preferred embodiment for pneumatically operating pins No. 2 and No. 3;

FIG. 30 shows the structure of FIG. 29 in extended position ready to embrace the vertical nail in the panel hole;

FIG. 31 is a further embodiment of pin structure;

FIG. 32 shows the adapter bar in side elevation;

FIG. 33 is a detail in end elevation;

FIG. 34 shows the floating bar on the top clamp;

FIG. 35 shows the guiding and longitudinal travel limit structure;

FIG. 36 shows the top clamp and adapter bar on top of a new panel being brought into position, and an adapter bar on the fixed panel;

FIG. 37 shows the mechanism in clamping position;

FIG. 38 is a schematic layout of the console panel;

FIG. 39 illustrates typical structure in plan for multi-valve operation of the top clamp and pins;

FIG. 40 shows the valve operation structure in elevation with the cover removed;

FIG. 41 is provided to illustrate a typical control circuit and may represent one portion of the structure of FIG. 40;

FIG. 42 shows a control circuit for operating pins 2 and 3 that engage the panel;

FIG. 43 shows a control circuit for operating pin No. 1 and the bottom clamp;

FIG. 44 shows a control circuit for operating the top clamp;

FIG. 45 shows a control circuit for operating the tilt mechanism;

FIG. 46 shows a locking circuit for operating the hydraulic levelers;

FIG. 47 is a circuit for operating the air over oil cylinder for the 45° tilt;

FIG. 48 is a control circuit for the air motor;

FIG. 49 is a truth table for operation of pin 1;

FIG. 50 is a truth table for operation of pins 2 and 3; and

Figure 51:
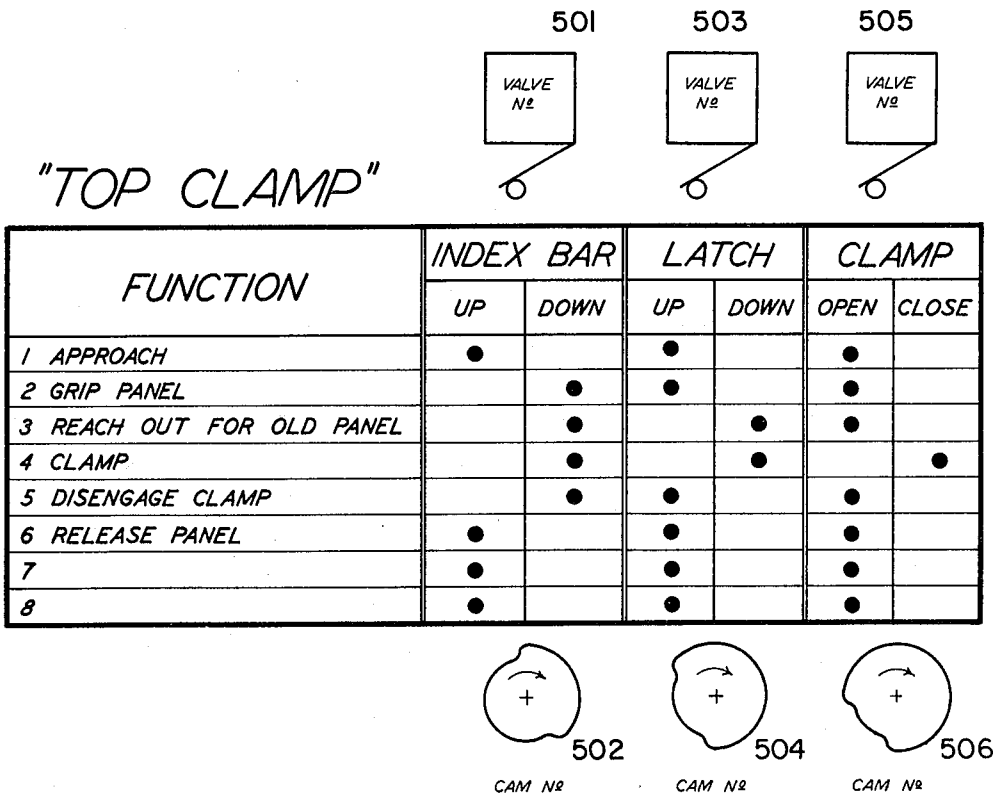

FIG. 51 is a truth table for operating the top clamp.

Figure 1:
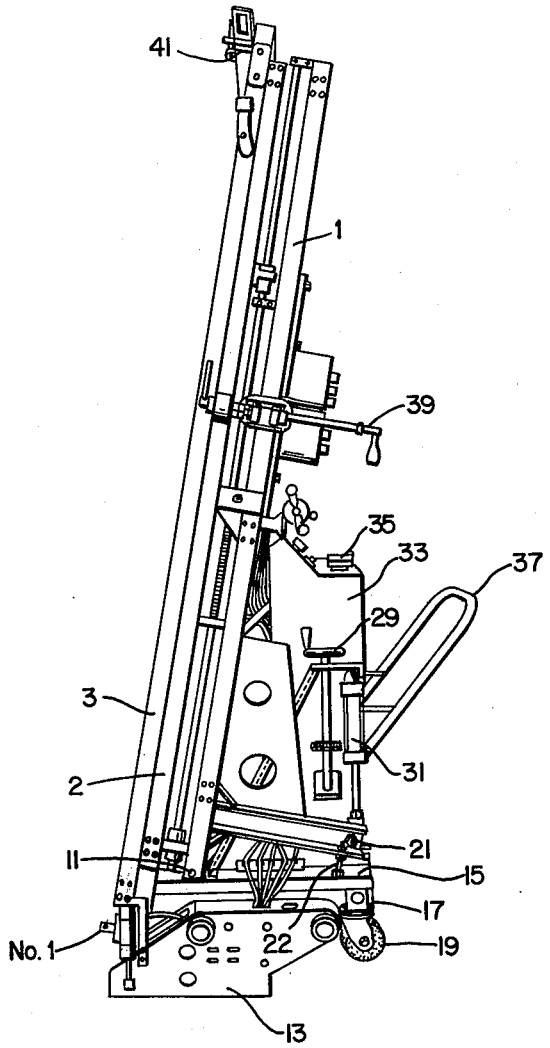
FIG. 1 is a side view of the preferred machine.

In FIG. 1, frames 1, 2 and 3 are visible in parallel relation with frame 1 being pivoted at 11 and frame 2 being placed between frames 1 and 3 for vertical movement relative to frame 1.

Frame 3 is the panel handling frame, and pin No. 1, for providing the clamping connection, is shown offset from frame 3, a portion of the extending mechanism for pin 1 being shown at 13. The lateral plate 15 is shown supported above the chassis 17, in turn carried by pivot wheels 19.

The lower beam 21 is shown attached to frame 1 and is positioned down against back stop 78 in the 11° tilt position. The plumb hand wheel 29 is provided to control the upper position of lower beam 21 and is adjustable for establishing plumb of the panel or for slight forward or rearward tilt. One of the air over oil tilt cylinders is visible at 31. The control console 33 carries multi-valve knobs 35. A handle 37 is provided for the operator to move the machine manually, and an extensible handle 39 is provided for the operator to reach out and pull a panel against frame 3. The top clamp mechanism is generally shown at 41.

Figure 2:
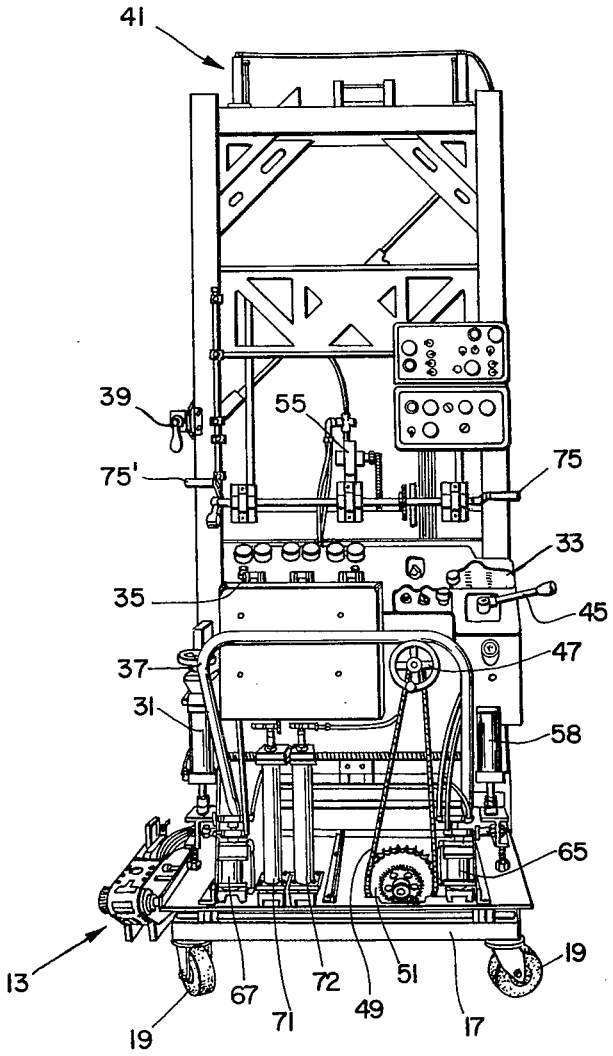
FIG. 2 is a rear view of the machine of FIG. 1.

In FIG. 2, the top clamp mechanism 41 is visible as seen from the rear. Console 33 carries the vertical lift handle 45. A lateral drive wheel 47 is connected by chain 49 to lateral drive sprocket 51 for manual movement of the panel right or left. Two of the pivot wheels 19 are visible in this figure as is the portion of the pin extending mechanism 13 for pin No. 1. The tilt cylinder 31 is located parallel to the other tilt cylinder 58.

The vertical drive motor 55 is positioned centrally of the machine above console 33. Three multiple valve control knobs, such as 35, are visible in this rear view.

The levelers air-over-oil vessels which power the leveller cylinders for establishing right and lefthand tilt are shown at 65 and 67. Between the levelers are shown the air over oil vessels 71 and 72 which are in communication with the 45° cylinders for providing conventional simple reciprocating motion wherein the oil is forced out and the air is exhausted.

The handle for vertical vernier movement manually is shown at 75. Although not visible in FIGS. 1 or 2, there is provided a compressor which need not exceed a rating of 1½ horsepower for supplying 100 psi air to power the system.

Figure 3:
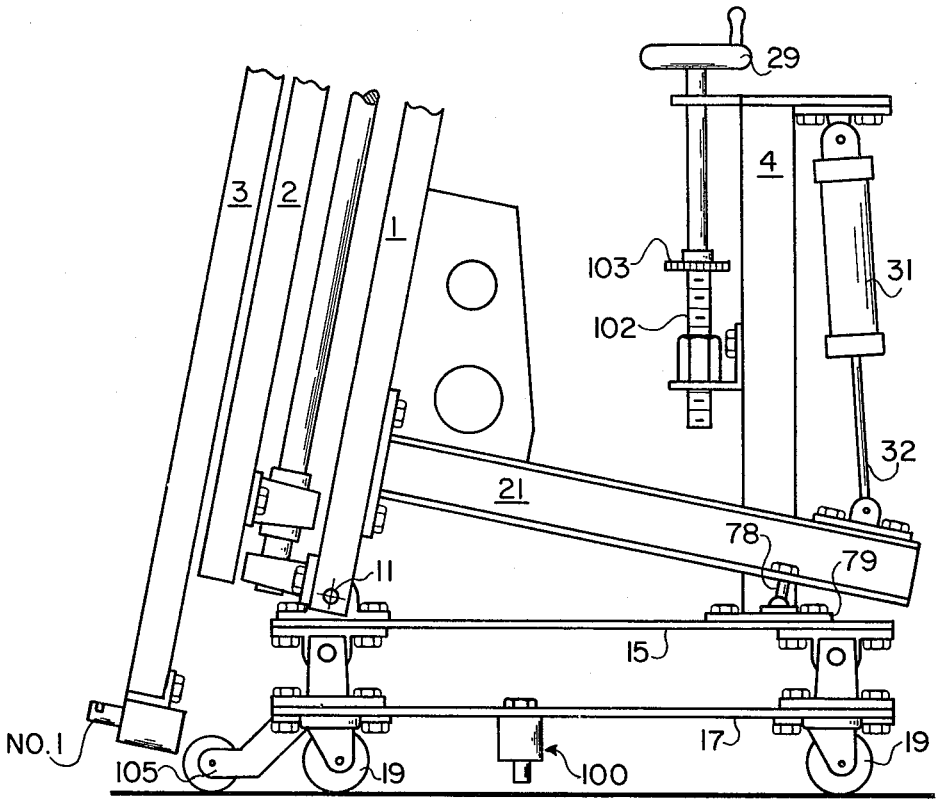
FIG. 3 is a partial side view of the machine to show an 11° tilt for the load handling apparatus.

In FIG. 3, the 11° tilt of all three frames 1, 2 and 3 is illustrated relative to the pivot 11, with the lower beam 21 shown with its' lug 78 against a reinforcing strip 79 carried by the lateral plate 15. This stops further backward tilt of the frames relative to lateral plate 15 and chassis 17. A pair of hydraulic cylinders 31 and 58 are respectively disposed between fixed frame 4 and lower beam arm 21 to conduct the frames to their rearward or 11° tilt position and for return drive to the vertical position. The cylinder 31 is powered by oil on top of the cylinder with air under the piston for simple reciprocal motion in communication with the reservoirs 71 and 72 of FIG. 2. The control circuitry for this operation is shown in FIG. 45 and will be discussed hereinafter. A pair of hydraulic levellers 100 are spaced apart generally centrally of the chassis 17 to establish tilting of the panel to the right or left, depending upon which is selectively energized, and apply slight adjustment for the horizontal leveling of chassis 17.

Figure 4:
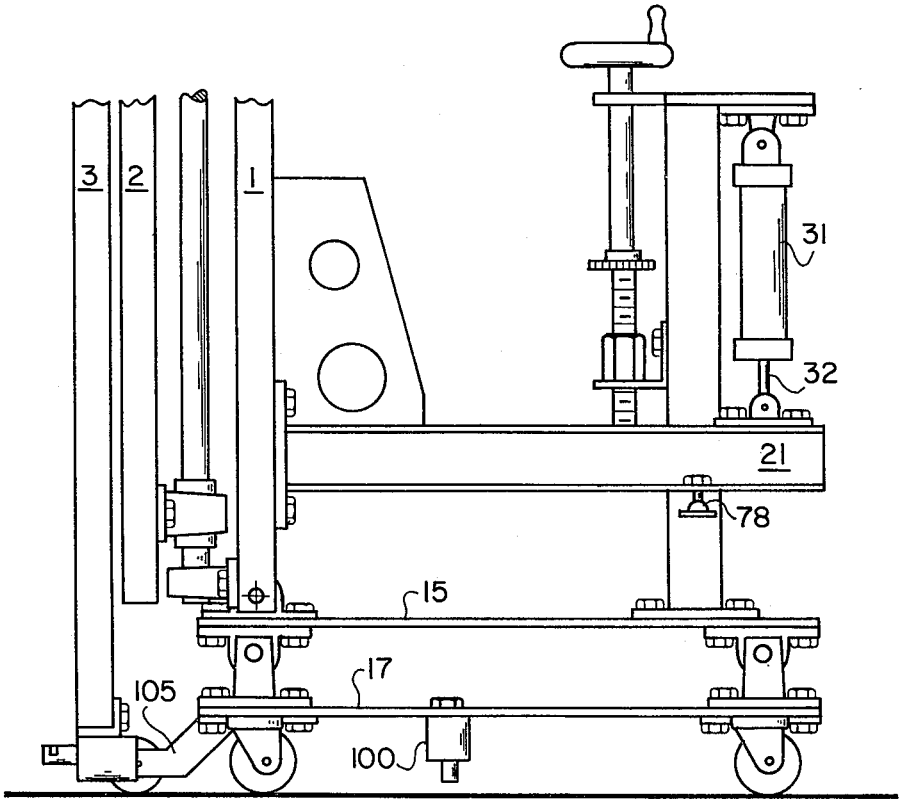
FIG. 4 shows the structure of FIG. 3 with the load handling apparatus in vertical or plumb position.

The backward tilt of the frames is provided to shift the center of gravity of the load rearwardly above the wheels for safety when the load is being transported. But the same structure is used to achieve plumb in the vertical plane. Even if the subfloor should deviate downwardly away from the wall then the machine can compensate for this by tilting the frame slightly forward. Adjustment for such compensation is achieved by means of the screw 102 in connection with plumb hand wheel 29. This is best seen in FIG. 4 wherein the lower beam arm 21 now bears upwardly against screw 102 and link 32 has been retracted into cylinder 32. Chain 103 connects screw 102 to identical structure on the far side of the machine.

Also, as best seen in FIGS. 3 and 4, fixed caster wheels 105 extend forwardly of the chassis 17 and serve as load bearing wheels when frame 3 receives the panel load, which may weigh in the neighborhood of 200 to 300 pounds.

Figure 5:
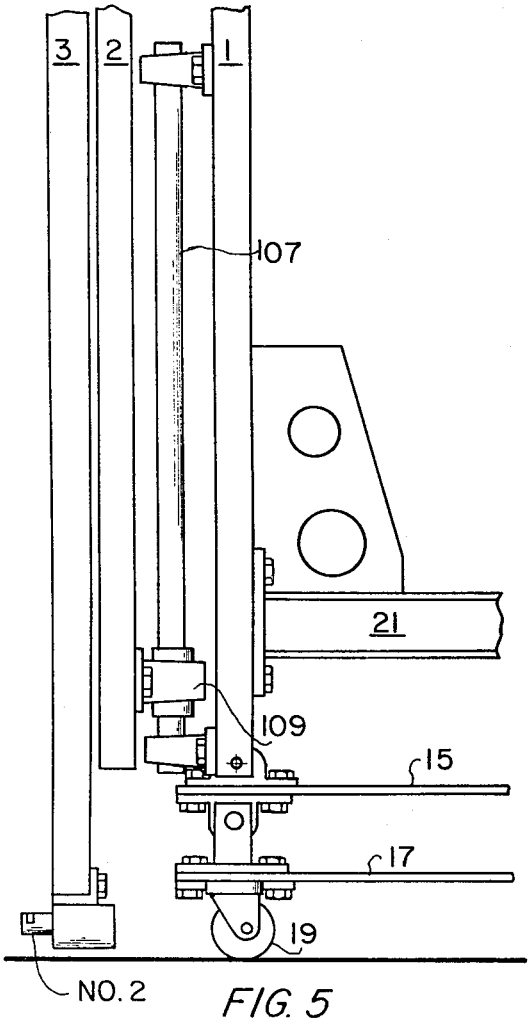
FIG. 5 is a partial view in side elevation of the machine to show details for the vertical lift mechanism.
Figure 6:
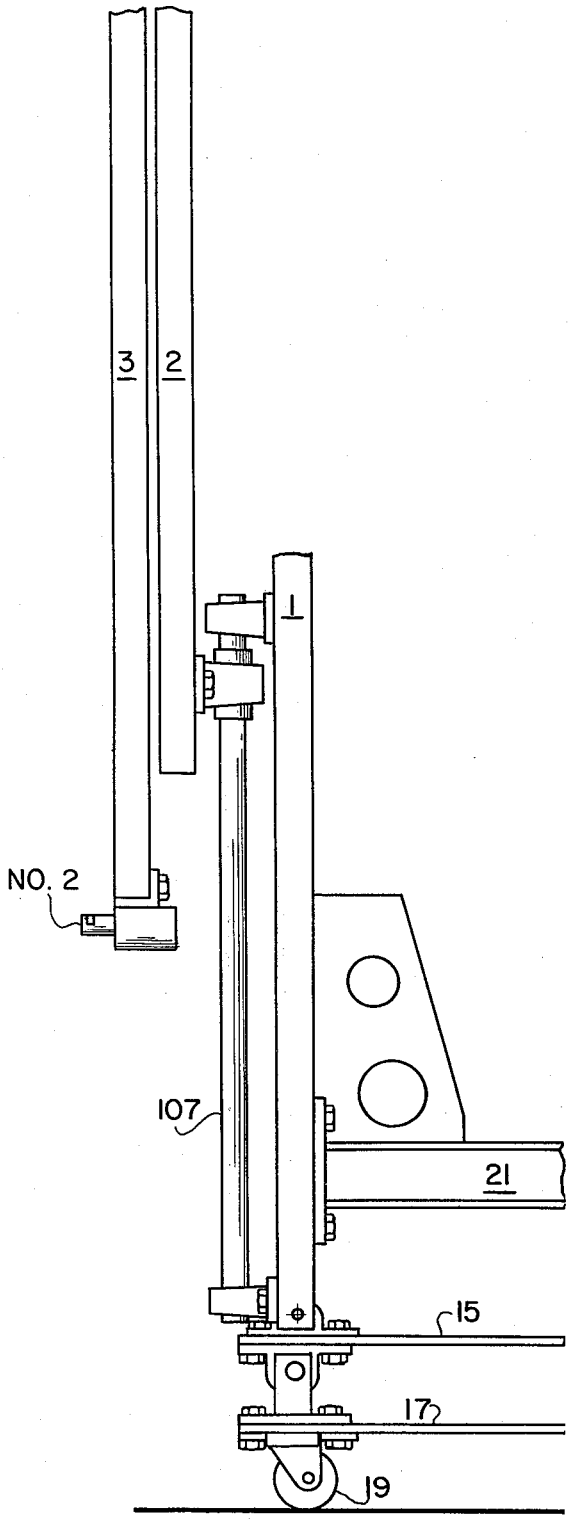
FIG. 6 shows the structure of FIG. 5 in upper position.
Figure 8:
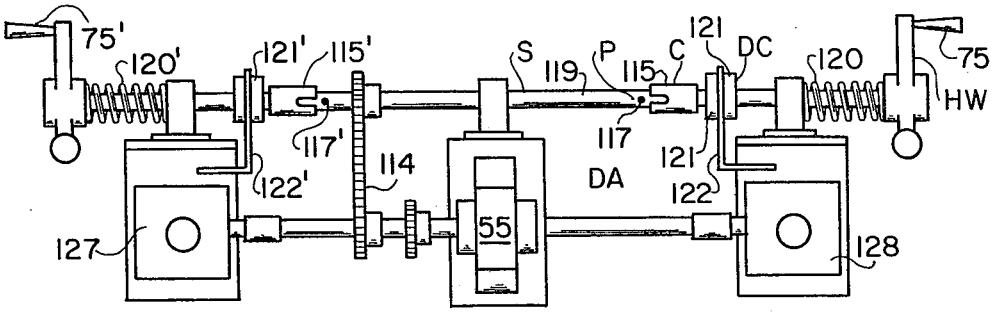
FIG. 8 is a view in plan of the vertical lift assembly.
Figure 7:
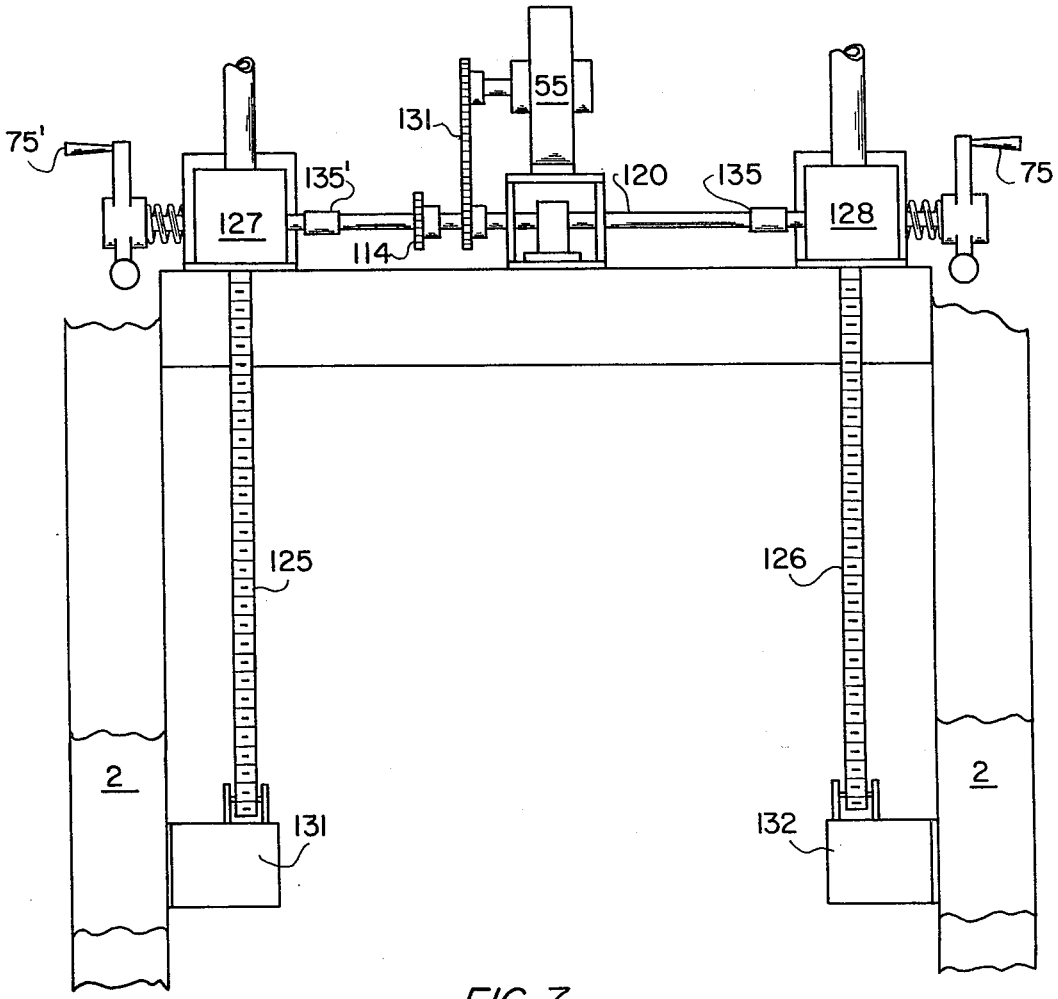
FIG. 7 is a view of the vertical lift assembly from the front of the machine.

FIGS. 5 and 6 are provided to illustrate the vertical lift mechanism of the subject machine. A pair of vertical shafts, such as 107 are carried by frame 1, and frame 2 is bearinged thereon at 109. Pin No. 2 and pin No. 3 (not visible in FIGS. 5 or 6) are carried by frame 3 and the structure is such that the pins No. 2 and No. 3 may be elevated 20 to 22 inches above the floor. This readily facilitates the handling of panels having 9 foot high exterior walls and 8 foot high interior walls and enables the location of baseboard pickup holes in the panel 1 foot above the lower edge of the panel while providing exterior sheating extending downwardly approximately 1 foot below the sill plate. The structure of FIG. 5 extends upwardly with frame 2 including further bearings on shafts in alignment with 107.

The mechanism to drive or lift frames 2 and 3 upwardly is best seen in FIGS. 7 through 12. Normally the air motor 55 is used for lifting and lowering, but for very precise adjustment, either of the hand wheels 75 and 75′ are used. Clutch 115 (FIG. 8) is pushed into engagement with pin 117 to turn shaft 119 by compressing spring 120 for manual operation of the lift over the chain. This arrangement ensures that handles 75 and 75′ will not revolve to catch an unsuspecting operator when the motor is operating at high speed.

The function of the air motor 55 is to pick up a panel off an elevated pallet, lift the panel over the floor key (merely a bevelled board nailed to the floor and adapted to fit within the panel between the exterior and interior walls thereof, see 229, FIG. 22) and lower the exterior panel over the edge of the subfloor for panels bearing 9 foot outside sheathing, but the described embodiment machine, of course, accommodates panels 8 foot by 4 foot, or incremental widths to 3 feet.

The drive is through non-rotating screws 125 and 126 which penetrate gear boxes 127 and 128, respectively, of worm gear actuators. The non-rotating screws 125 and 126 are connected to frame 2 by offsets 131 and 132 to impart motion from motor 55 over chain 131 and via shaft 120 and gear boxes 127 and 128 to move the frame 2 upwardly or downwardly. This operation is quite rapid and readily handles the 200 or 300 pound loads encountered, but running of the motor does consume considerable amounts of air and for this reason it is often desirable to use the manual handles 75 or 75′, particularly for small adjustments where the motor may overrun and need be reversed, which is accomplished by simply valving the air flow to the opposite direction.

The safety provision for handles 75 and 75′ takes advantage of the fact that the pneumatic motor will freewheel when manual adjustment is being used, but a drag clutch 121 with drag arm 122 prevents unwanted rotation of hand wheels 75 and 75′ while the air motor is driving the system in the event of shaft bind or misalignment. Also, flexible couplings 135 and 135′ provide added tolerance to shaft 120 for the high speed drive.

Figure 9:
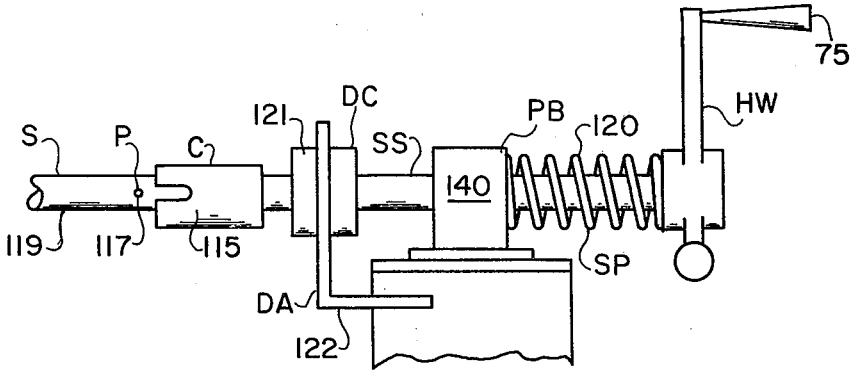
FIG. 9 shows the manual adjustment for the vertical assembly in inoperative position.
Figure 10:
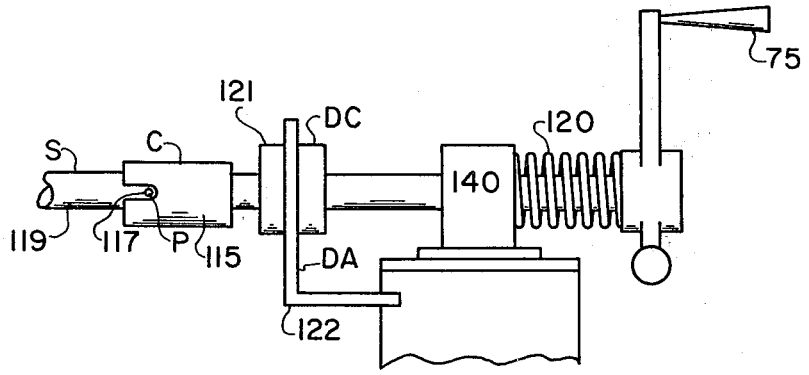
FIG. 10 shows the manual adjustment in operative position.

In FIGS. 9 and 10 the longitudinal restraint displacement of shaft 119 is occasioned by a pillow block 140. Spring 120 normally maintaining the clutch 115 and hand wheel in a disengaged condition (FIG. 9).

FIGS. 11 and 12 show further details of the connection of the air motor drive to frame 2. Upper housings such as 144 are provided to protect the long non-rotating lifting screw, such as 125 when elevated.

FIGS. 13, 14 and 15 illustrate the lateral movement mechanism which allows mechanical advantage provided by sprocket ratios of the driving sprocket or pulley carried by lateral drive wheel 47 and sprocket wheel 51, connected by chain 49. This allows the panel being installed to be forcibly manipulated into initial juncture, i.e., if tongue and groove connections are used, which is optional. The lateral movement is arranged for approximately 4 inches and is more than sufficient to perform the required functions. Racks 151 and 151′ are carried on the two main support shafts 152, 152′ which in turn are supported by blocks or bushings 153 uprising from chassis 17. These two main shafts carry the lateral plate 15 through ball bushings for movement of all three frames together. Also, in these figures the fixed casters 105 may best be seen.

In FIG. 15, there is shown a top or plan view of the lateral movement driving means wherein the racks 151 and 151′ are shown carried by the main supporting shafts 152 and 152′ in an arrangement that ensures parallel movement of the lateral plate 15 (and the entire upper tool) without resort to heavy and expensive members. The entire machine moves laterally on four ball bushings, such as 154 which bear on two lateral steel shafts 152 and 152′. To preclude typical sticking or slipping, binding or other hazards of parallel sliding assemblies and to ensure that the loaded platform moves dependably and with minimum skewing, a torque rod 160 is mounted in bearings 161 and 162 to cause two spur gears 51 and 51′ to engage and mate with racks 151 and 151′ mounted on the stationary rods 152 and 152′. Thus, any tendency of one side of the lateral baseplate 115, due to uneven loading, to move ahead of the other side is prevented by the keying action of the gears in the respective racks. A disc brake 166 is provided to prevent lateral movement except when desired. A caliper brake 165 restrains the entire tool by bearing against disc 166, except when released for deliberate lateral movement under pneumatic control.

The 45° traverse or lift assembly is best shown in FIGS. 16 and 17 wherein frame 2 remains stationary and frame 3 moves relative thereto, as a result of one or more cylinders 170 driven upwardly by oil and downwardly by air said oil provided by air-over-oil vessels 71 and 72 of FIG. 47. Ball bushings 171 and 172 are attached to frame 2, whereas the 45° shaft 175 is affixed to frame 3 by end bearings 176 and 177. Cylinder 170 is screwed to horizontal bar 178 of frame 2. Accordingly, cylinder arm 179 grips 45° shaft 175 through offset 181 to move frame 3 up and down along a 45° angle so that once the panel is oriented into its aligned position, it may be reciprocated away from said position by cylinder 170 and various types of adhesive may be accommodated due to the fact that the panel may be homed simply by pneumatic control of cylinder 170 after the selected adhesive has been applied.

Oil is applied to the underside of the cylinder to lift the load for smooth drive with return being by air. The 45° shafts 175 and 190 (which preferably includes a corresponding cylinder 170′, not shown, and related structure) may be of ¾ inch outside diameter round shaft material and the cylinders need accommodate only approximately 6½ inches of drive to provide a good working machine.

Pin No. 3 and pin No. 2 are clearly visible in this front view and, as may be seen, their positions are elevated and shifted to the left in FIG. 16 relative to the home position of FIG. 17. Also, some further supporting structure may be seen in these views including shaft support blocks 153 for supporting the main support shafts 152 and 152'. Affixed to the top side of the lateral baseplate 15 may be seen the ball bearing pillow blocks 198 and 199 which hold pivot shaft 11 for the pivoting of all three frames 1, 2 and 3.

FIGS. 18, 19 and 20 best picture the No. 1 pin clamp arrangement for forcibly drawing the subassembly bearing pin No. 1 toward the machine, thus providing a means to clamp the new panel being installed forcibly against the previous panel with the force of some 500 or more pounds.

FIG. 18 shows pin No. 1 retracted and FIG. 19 shows pin No. 1 extended away from chassis 17 in order that a drawing force may be exerted thereon to push the panel carried by frame 1 against a previously installed panel.

The parallel motion arrangement of FIG. 20 is employed to avoid sticking, slipping, binding or skewing. (A portion of the supporting or extending mechanism for pin No. 1 is shown at 13 in connection with push-/pull road 201 extending from pneumatically controlled cylinder 203. Two parallel rods 205 and 206 (generally disposed between the main support shafts 152 and 152' and at the same level) slide through four ball bushings 207, 208, 209 and 210 and are rigidly fastened through the pin No. 1 extender subassembly 13. Torque rod 212 cases two spur gears 213 and 214 to bear and engage racks 215 and 216 which are secured to the rods or shafts 206 and 205, as a result of bearings 217 and 218.

When the machine is maneuvered adjacent to a previously installed panel, pin No. 1 may be extended to align with a pin receiving hole in the fixed panel, inserted and locked to such panel and thereafter cylinder 203 actuated to withdraw push/pull rod 201 thereby forcing the panel held by frame 1 against the fixed panel.

FIGS. 21 through 31 show some suitable pins and pin operating structure. The preferred pin is shown in FIG. 21 at 220 and may serve as any of pins No. 1, No. 2 and No. 3. It includes a slot 221 cut into one end along a diameter thereof with an offset slot 222 in communication with slot 221.

In FIG. 22 a typical wooden wall panel 225 is shown having an exterior member 226, an interior member 227 and a framing member 228, the insulation being included above horizontal framing member 228, but not shown. Also a key 229 affixed to the floor where the panel is desired to be assembled is shown in position in channel 230 of panel 225. However, before the panel was set on the alignment key 229, a nail 235 was driven vertically upwardly across the non-penetrating hole or opening 237. When the pin 220 approaches the hole 237, its slot 221 is vertical as seen in FIG. 23. However, as seen in FIGS. 24 and 26, when the pin is engaged, slot 221 is now out of the vertical and the nail is disposed in slot 222. These operations are all carried out pneumatically as will be further explained.

In FIG. 26 one embodiment of structure suitable for driving pins No. 2 or No. 3 is shown wherein the pin 240 includes a piston 241 in cylinder 242 with extension shaft 243 provided for engagement by a yoke 245 including a pivotal eye 247 arranged as a clevis and operated by a further shaft 249. The air passages 251 and 252 are provided to drive pin 240 forwardly and rearwardly to the insert and retract positions.

Shaft 249, preferably driven by a pneumatic cylinder is provided to rotate extension 243 so that the vertical slot is displaced from the vertical to cause the offset slot 253 to engage the nail in the panel.

FIG. 27 shows pin 240 rotated to capture the vertical nail in the hole and FIG. 28 shows pin 240 returned with its slot in the vertical position for approach or release of the nail.

FIGS. 29 and 30 include cylinder 260 adapted to be pivotally supported at 261 for driving shaft 249 to rotate the extension 243 and consequently pin 240. FIG. 29 shows the pin in the retracted position with the capture slot of the pin in the vertical position and FIG. 30 shows the pin 240 in the extended position ready to embrace the vertical nail in the panel hole. This, of course, is accomplished by air pressure at inlet 265 of cylinder 260 retracting shaft 249 and pivoting pin 240 into locking engagement with the nail.

The longitudinal displacement of pin 240 was occasioned by air pressure being applied to inlet 266 of pin cylinder 242.

A slightly different embodiment is shown in FIG. 31, primarily intended for use as pin No. 1. The extendable and rotatable pin 270 passes through a support member 271 extending from chassis 15 and intended to bear the vertical lifting load and also the lateral forces generated in clamping one panel against another. Cylinder 272 is provided with clevis 273 to cause the locking and unlocking rotational action and cylinder 275 is provided for direct thrust against the pin into the hole and then after rotative locking occasioned by cylinder 272 to pull back the panel against the machine for further handling.

FIGS. 32 and 33 show a very useful adapter bar 280 for facilitating the top clamp action. The adapter bar is adapted to fit on the top of a panel and three such bars may suffice to maintain continuous construction using the machine—one on the fixed panel provides a gripping point, one on the panel being carried enables the tremendous force and a third on the next upcoming panel prevents interruption. With such an arrangement, transfers thereafter are easy. The adapter bar is preferably of steel to withstand the forces encountered and includes depending connections for three holes drilled in the top of every panel. The holes are drilled always a fixed distance from the face that mates with the tool so that thick and thin panels can be accommodated without modification of either the machine or the adapter bars. Stud 281 at the left end of the adapter bar fits within a hole in the top of the panel and carries above it anchor stud 283 against which the top clamp assembly 41 pulls. It is for this reason that the middle stud 285 is expansible by locating a conical nut within its lower end and drawing the same upwardly to spread the stud and provide tremendous anchoring force because the clamping force of say 500 pounds applied against anchor stud 283 creates a turning moment that tends to tip the bar upwardly out of the panel and the expansible stud resolves this problem. The forward stud 287 fits a hole in the panel and includes thereabove an index guide pin 288.

The top clamp assembly 41 descends upon the adapter bar 280 (FIGS. 36 and 37) by using the forward conical stud 288 as a locator guide because the conical stud guides itself into mating bushing 289 of the lower bar 290 of the top clamp assembly 41.

Air cylinders 301 and 302 drive top clamp bar 290 down against adapter bar 280 and also serve to lift the top clamp assembly 41 out of engagement with adapter bar 280. Anchor pin 283 penetrates the end of top clamp bar 303 through an opening 305. Grip 305 is held up by air cylinder 306 out of engagement with stud 283' of fixed panel 307. When clamping is desired, cylinder 306 lowers grip 305 to capture stud 283' and then cylinder 309 squeezes the new panel 310 against the fixed panel 307, as best seen in FIG. 37. The bar 315 holding cylinder 309 floats on bar 290 as is the case with bar 317 holding cylinder 306 in order to permit the squeeze action wherein the cylinder structures are drawn closer together, both being moved in FIG. 37.

This floating is shown in FIGS. 34 and 35 wherein shoulder bolts such as 320 in recessed grooves 321 serve as guides and also limit longitudinal travel.

Rod (A) of air cylinder 301 attaches to frame No. 3, guide rod (B) is pivotally attached to 41 and extends downwardly through ball bushings fixed in frame No. 3 thus providing lateral restraint but allowing vertical freedom of 41.

PNEUMATIC CONTROLS

The remaining description will relate to the pneumatic controls which serve the dual function of control and power simultaneously without requiring electrical wiring of the machine. A compressor (not shown) may be equipped with wheels to travel with the machine or it may be stationary and have a long pressure hose leading to the main manifold of the machine which distributes the air in accordance with FIGS. 38 through 51. In FIG. 38 there is shown the multi-valve knobs such as 35 for pin No. 1, 325 for pins No. 2 and No. 3 (which are operated in parallel) and 327 for the top clamp. These multiple operation valves are arranged as a programmer shown at 330 in FIG. 40, later to be described.

In FIG. 38, the 45° movement to the up position and the down position is controlled by knob 333, the vertical lift by handle 335 and the tilt forward or backward by knob 336. The levelers are controlled as to the left one up by switch 337 and down by switch 338 and as to the right one by switches 339 and 340.

Returning to the programmer 330 of FIGS. 39 and 40, it may be seen that a common shaft 342 is controlled by knob 343 and in turn detent pressure is supplied at several steps around the knob by detent 344. In FIG. 40, there are shown three or four way valves 346, 347 and 348 connected for operation by programmer 330. These programmers are commercially available with up to 13 different valves. Valve 346 is operated by a special cut cam 349, valve 347 by cam 350 and valve 348 by cam 351. These valves deliver power air to their connected cylinders.

This is represented in FIG. 41 wherein a 4-way valve 400 is actuated by cam follower 401 in accordance with the contour of cam 403 to open and close the passages 405 and 407 to pneumatic cylinder 409 thereby controlling the extension or retraction of shaft 410. The purpose of the programmer 330 is to tie the operation of circuits such as that of FIG. 41 together through a common knob for control.

Considering now FIG. 42, there is shown the plumbing or pneumatic control circuits for controlling pins No. 2 and No. 3. Reference to FIG. 38 will show the use of knob 325 by the operator in connection with the truth table of FIG. 50 to show the operation of the various valves in controlling their associated cylinders. Pins No. 2 and No. 3, it will be recalled, are provided to engage the panel initially and assist in its transport and handling thereafter. Both FIGS. 42 and 50 show the three valves 425, 426 and 427. Valve 425 is operated by cam 428 to control the function of retracting pins No. 2 and No. 3 connected in parallel and operated by cylinders 430 and 431.

Valve 426 controls the insertions or extensions of pins No. 2 and No. 3 under guidance of the contour of cam 429.

Valve 427 follows cam 432 to control rotation of pins No. 2 and No. 3 through cylinders 440 and 441. The hardware for this structure is shown in FIGS. 26–29.

By way of example, 70 psi may be delivered to the valving arrangement of FIG. 42 over passageway 450 to manifold 451.

Looking now at FIG. 50, the truth table shows that for the first function step pins No. 2 and No. 3 should be in the approach condition, i.e., retracted. Thus, the black dot at step 1 approach under the back column for both pins indicates that valve 425 is depressed, passing air and pulling the piston back. The only other activity during step 1 is that valve 427 is open to orient the vertical slot to its vertical position which is the nail receiving position or the non-locking position.

In step 2 the pins are inserted or extended and accordingly, valve 425 is no longer open passing air but valve 426 is to drive both pins outwardly, valve 427 remains in its position to maintain the slot vertically.

From function step 3 both valves 425 and 426 are relaxed so that there is no air pushing or pulling either slightly backwardly or slightly forwardly on pins No. 2 or No. 3 in order that the locking function may be achieved easily by closing valve 427 to pass air so that cylinders 440 and 441 rotate pins No. 2 and No. 3 to lock into their respective nails.

The next step is to pull the panel to the machine and consequently valve 425 is energized to retract pins No. 2 and No. 3 via cylinders 420 and 431 with valve 427 remaining in the locked position.

Thereafter, the pins No. 2 and No. 3 remain in the position just described until it is time to release the machine from the panel which has now been attached to the floor and/or other panels.

The releasing step No. 5 is accomplished by relieving the pressure from valves 425 and 426 in order that valve 427 may actuate cylinders 440 and 441 to cause rotatin of pins No. 2 and No 3. to the unlocking position. In step 6 the pins are retracted by actuating valve 425. It should be noted that step 6 has the same valves actuated as step 1 and that steps 7 and 8 are also redundant. This is because the commerically available valve includes a greater number of actuating positions, as seen in FIG. 38 at 325 where there are eight positions, than required by the present machine.

Next, the operation of pin No. 1 is carried out in a similar manner and is illustrated in FIGS. 43 and 49, it being recalled that pin No. 1 is extended to lock in the fixed panel, then pull the panel against the machine and then clamp the joint by pulling laterally, thereafter releasing or unlocking from the nail and retracting the pin. Accordingly, for function step 1 the pin should be retracted and valve 450 operating under control of cam 451 operates cylinder 452 to retract pin No. 1. At the same time valve 453 is open so that cylinder 454 is not rotating pin No. 1 to lock it.

With respect to the clamping action, it is noted that valve 455 is in the reaching position and so energizes cylinder 203 (of FIG. 20) to extend push rod 201. Valve 460 of cylinder 452 and valve 461 for clamping cylinder 203 were not used. Thus it may be seen that valves 450 and 460 control forward and backward movement of pin 1 through cylinder 452. Valve 453 controls locking and non-locking of pin No. 1 onto the nail through cylinder 454 and valves 455 and 461 control clamping cylinder 203.

In step 2 when pin No. 1 is inserted, valve 460 is energized to drive it forward, valve 453 remains energized with the slot vertical and valve 455 maintains the reaching.

In step 3, valves 450 and 460 are neutral to avoid friction, valve 453 drives locking cylinder 454 to the locking position and valve 455 remains in the reaching position.

Next, the panel is pulled to the machine by energizing valve 450, locking action persists by energizing valve 453 to the locking condition and the clamping cylinder is neutral so as not to interfere with pulling the panel tightly against the machine.

Next, the clamping of the joint is accomplished in step 5 by maintaining valves 450 and 453 as they were and energizing valve 461 to the clamping position so that cylinder 203 exerts its tremendous force for squeezing the panels together. At this point it might be pointed out that tongue and groove panelling requires an extra reach and the machine may be designed to accommodate this extra reach.

In step 6, valve 453 opens the lock so that in step 7 valve 450 may retract the pin.

The top clamp circuitry is shown in FIG. 44 and works in accordance with the truth table of FIG. 51. Air cylinders 301 and 302 are actuated by valve 501 to control the raising and lowering of the top clamp indexing bar to capture the adapter bar under control of cam 502. Valve 503 under control of cam 504 controls the gripper or latch member 305 as to whether or not it's up or down to catch stud 283'.

Valve 505 under control of cam 506 controls the clamping action by controlling cylinder 309. In step 1 the index bar is up by valve 501, the latch is up under control valve 503 and no clamping pressure is exercised under control valve 505 in order that the new panel may be gripped.

Gripping is accomplished by causing air cylinders 301 and 302 to push downwardly under control of valve 501 with the latch remaining in its up position under control of valve 503 and cylinder 306 (FIG. 36).

Next, in step 3, reaching for the old panel is accomplished by lowering the latch or grip 305 under control of valve 503 through cylinder 306.

In step 4 clamping is accomplished by valve 505 energizing cylinder 309 to provide the squeezing action.

The clamp action is disengaged by releasing latch or gripper 305 (FIG. 36) through cylinder 306 and also releasing the clamping action through valve 505 effective at cylinder 309.

Finally, the panel is released so that the machine may be moved to handle the next panel by raising the clamping mechanism 41 through cylinders 301 and 302 under control of valve 501, maintaining the latch up under control of valve 503 and maintaining valve 505 as it was to maintain cylinder 309 relieved of exerting the gripping force.

In FIG. 45 the tilt circuit for the frames 1, 2 and 3 is shown under control of the vertical lift arm 335 of FIG. 38. A 4-way valve 601 controls the forward and backward tilt cylinders 31 and 58 (FIGS. 1 and 2) by controlling the air over oil pressure in the tanks 71 and 72. A pneumatic operator 603 which is comparable to a solenoid on an electric solenoid valve is used to control 2-way valve 605. Application of air pressure to 603 causes a small piston to move the stem of 2-way valve 605.

Thus, both cylinders 31 and 58 are operated together with oil on the top and air on the bottom used for return. The shuttle valve 607 routes air to operator 603 which opens the 2-way valve 605 anytime air is passing through the main control valve 601. This essentially unlocks the oil circuit to either admit more oil or to retract the cylinders by means of air and thus return some oil to the air over oil vessel.

Pneumatic circuit 46 provides control over the hydraulic levelers such as 100 and includes a locking circuit for the same. A 3-way valve 701 applies pressure to the air over oil vessel 67 of FIG. 1 and the 2-way normally closed valve 702 traps oil on top of the leveler piston. This locks the piston in a down position and holds the piston in a desired stance. The pneumatic operator 703 opens 2-way valve 702 anytime that air is admitted to the air over oil vessel 67 and also on a return. Thus, the oil circuit is over conduit 705 to the piston 100 (FIG. 4) to push the piston against the floor.

Three-way air valve 710 is provided to retract the piston through air return with shuttle valve 711 directing air through and blocking back flow.

In a similar fashion the opposite leveller 100' is operated downwardly by 3-way air valve 715 and upwardly by 3-way air valve 716 with the same locking provisions.

In FIG. 47 the pneumatic circuitry for the 45° traverse to open the joint for glue application is shown. The driving cylinders are 170 (FIG. 16) and 170' which cause the up and down movement. The 4-way valve 725 controls pressure to the air over oil vessels 71 and 72 (FIG. 1) wherein the compressed air driving oil out to the cylinders to provide simple operation of a hydraulic circuit without the expense and complexity of using a mechanically driven pump.

In FIG. 48 there is shown the circuitry for driving air motor 55 which comprises a 4-way air valve 750 which is spring-loaded for dead center and is operated under control vertical lift handle 335 (FIG. 38). The air motor 55 is supplied by high pressure air over either line 751 or 752 to determine the direction in which it drives. Both lines are provided with quick exhaust valves 753 and 754.

What is claimed is:

1. A pneumatically operable wall panel indexing and installing machine comprising in combination, a base chassis including wheels;

a lateral plate carried by the chassis;

means to move the lateral plate laterally of the chassis;

a first frame pivotally secured to the forward end of the lateral plate;

a second frame;

means for lifting and lowering the second frame relative to the first frame;

a third frame adapted to grip a wall panel;

means for reciprocally moving the third frame at an angle of 45° relative to the second frame;

means for tilting the first, second and third frames with the panel backward relative to the lateral plate to locate the center of gravity of the panel over the base chassis wheels;

stop means for locating the frame and panel in predetermined backward tilt relative to the lateral plate;

plumb means for locating the frames in the vertical or at predetermined forward tilt; and, locking means for locking the machine against movement relative to existing wall structure whereby the panel may be indexed to existing wall structure and reciprocated away from and back to an indexed position.

2. The machine of claim 1 wherein the third frame comprises, a plurality of pins;

means for extending the pins forwardly of the base chassis, selectively rotating the pins in one direction and in the opposite direction, and retracting the pins, and said pins comprising a diametrical slot in their forward ends and an offset slot opening laterally of the diametrical slot.

3. The machine of claim 1 comprising, clamping means for connection to existing wall structure, and means for pulling the panel against the existing wall structure by the clamping means.

4. The machine of claim 3 wherein one of the clamping means comprises, a pin;

means for extending said pin away from the chassis laterally and retracting and pin forcefully;

means for extending said pin forwardly of the chassis, rotating the pin selectively in one direction and in the opposite direction, and retracting the pin rearwardly toward the chassis; and said pin comprising a diametrical slot in the forward end of an offset slot opening laterally of the diametrical slot.

5. The machine of claim 3 wherein one of the clamping means comprises, an adapter bar secured to the top of said panel and comprising grippable means and indexing means;

an adapter bar secured to the top of the existing wall structure and comprising further grippable means; and means for gripping said grippable means and said further grippable means to pull said panel forceably against said wall structure.

6. The machine of claim 5 wherein said means for ripping comprises, a base bar offset from the top of the third frame forwardly thereof in position above the panel;

pneumatic means for lowering the base bar against said adapter bar and raising the base bar out of contact with the adapter bar to said position above the panel;

further bar means in floating engagement with the base bar and in sliding contact with the upper surface of the base bar;

said means for gripping comprising an opening in said further bar means to receive said grippable means, a grip for receiving said further grippable means;

a pneumatic cylinder for raising and lowering said grip to capture and release said further grippable means; and a further pneumatic cylinder for drawing said further bar means together to pull on both said grippable means and said further grippable means.

7. The machine of claim 6 further comprising, valve means for said pneumatic means;

second valve means for said pneumatic cylinder;

third valve means for said further pneumatic cylinder; and means to operate said valve means selectively.

8. The machine of claim 3 wherein the locking means comprise, leveling means effective between the support for the chassis wheels and said chassis to level the chassis to the horizontal.

9. The machine of claim 3 wherein the means to move the lateral plate comprises, a pair of supporting members carried in spaced-apart relation by the chassis;

racks supported by the members respectively;

torque bar means supported by the lateral plate for rotation and extending between the racks;

a pair of spur gears carried by the torque bar means in mating engagement with the racks; and manually operable means for rotating the torque bar of the torque bar means in opposite directions to move the lateral plate oppositely relative to the chassis.

10. The machine of claim 9 further comprising, disc brake means carried by the torque bar; and a caliper brake effective at the disc brake means for locking the lateral plate against movement.

11. The machine of claim 3 wherein the stop means comprise, a lower beam extending rearwardly from the first frame and generally normal thereto; and, said stop means comprising a protrusion between the lateral plate and said beam to preclude further movement of the beam and frames.

12. The machine of claim 3 wherein the means for lifting and lowering the second frame comprises, guide means carried by the first frame;

bearing means coupling the second frame to the guide means for longitudinal movement relative to the first frame; and, pneumatic motor means supported by the first frame and coupled to the second frame to drive it up and down.

13. The machine of claim 3 wherein the means for lifting and lowering the second frame comprise, at least one non-rotating screw attached to the second frame;

a worm gear actuator for lifting and lowering the screw;

a shaft for actuating the worm gear actuation; and a pneumatic motor for driving the shaft.

14. The machine of claim 13 further comprising, a second shaft adjacent said shaft;

means coupling the second shaft to said shaft;

clutch means carried by said second shaft, and manually operable means for engaging said second shaft in said clutch to drive the shaft and the screw to raise or lower the second frame.

15. The machine of claim 3 wherein the clamping means comprise, a pair of spaced-apart support members carried by the lateral plate transversely of the chassis;

a rack carried by each member;

a torque bar extending between the racks and supported for rotation from the lateral plate;

a pair of spur gears carried by the torque bar in mating engagement with the racks, respectively;

a push-pull rod carried by the lateral plate and extendible laterally away from the chassis;

a pin sub-assembly slidably mounted on said support members for movement away from said chassis and retraction toward said chassis by said push-pull rod;

said pin sub-assembly comprising a pin having a diametrical slot in the forward end thereof opening into an offset slot, means to extend the pin forwardly relative to the chassis and retract the pin, and means for bidirectionally rotating the pin and locking it in position; and, said means for pulling the panel comprising a pneumatic cylinder for pushing and pulling the push-pull rod.

16. The machine of claim 3 wherein the means for tilting comprise, a pair of cylinder means for establishing relative movement between the first frame and the lateral plate;

said cylinder means comprising a pair of oil over air fluid operated cylinders connected in parallel, a two-way valve, an air over oil vessel, and an air valve interconnected to actuate the pneumatic operator via the shuttle valve whenever the air valve admits air thereby supplying more oil to the top of the cylinder or retract air from the bottom of the cylinders to return same oil to the air over oil vessel.

17. Construction panel handling apparatus for assembling a single panel to one or more panels comprising, in combination, means for releasably gripping the single panel;

means for moving the single panel up and down along its longitudinal axis relative to said one or more panels;

means for moving the panel right and left at substantially right angles to the direction of up and down movement generally along its axis 90° to the longitudinal axis in the plane of the single panel;

means for tilting the panel forwardly or rearwardly of the direction of up and down movement in a direction generally orthogonally of said axes;

means for reciprocally moving the gripping means along a predetermined path to contact the single panel against said one or more panels;

support means for the means for moving, tilting and reciprocally moving; and clamping means extendable and retractible laterally of the support means for gripping said one panel and forcing the single panel against said one panel.

18. The apparatus of claim 17 wherein, the support means comprises a wheeled chassis;

the means for moving the panel right or left comprises a lateral plate above the chassis for lateral movement relative thereto;

the means for tilting the panel forwardly comprises a first frame pivotally supported by the lateral plate;

the means for moving the panel up and down comprises a second frame carried by the first frame for longitudinal movement relative thereto; and the means for reciprocally moving comprises a third frame carried by the second frame and mounted for 45° movement relative thereto.

19. The apparatus of claim 17 wherein the clamping means comprise, lower clamping means carried by the support means for engaging said one panel near the bottom thereof; and, upper clamping means carried on top of said single panel for engaging said one panel at the top thereof.

20. Construction panel handling apparatus for assembling a single panel to an edge of another panel and the floor simultaneously comprising in combination, means for releasably gripping the single panel;

means for moving the releasable gripping means up and down to move the single panel vertically relative to said another panel and floor to locate the single panel vertically adjacent the another panel and the floor;

means for moving the releasable gripping means toward and away from said another panel edge to locate the single panel horizontally adjacent said another panel;

means for tilting the releasable gripping means in the direction of said edge and away from said edge to compensate for vertical misalignment in the plane of said another panel to compensate for vertical misalignment generally normal to said aforementioned vertical misalignment;

means for establishing a path for said releasable means at an angle of substantially 45° to said edge and floor;

means for reciprocally moving the gripping means back along said path to permit glue to be applied for said assembly and forth along said path to contact the single panel against said edge and floor simultaneously;

transport support means for all said means for moving; and, clamping means extendible and retractable laterally of the transport support means for gripping said another panel and forcing the single panel against said edge.

* * * * *